US011732881B1

(12) United States Patent
Yu

(10) Patent No.: US 11,732,881 B1
(45) Date of Patent: Aug. 22, 2023

(54) LEATHER WORKPIECE AND MANUFACTURING METHOD THEREOF

(71) Applicant: Hiroca Automotive Trim Corporation, Taoyuan (TW)

(72) Inventor: Che-Ming Yu, Taoyuan (TW)

(73) Assignee: Hiroca Automotive Trim Corporation, Taoyuan (TW)

( * ) Notice: Subject to any disclaimer, the term of this patent is extended or adjusted under 35 U.S.C. 154(b) by 0 days.

(21) Appl. No.: 18/169,224

(22) Filed: Feb. 15, 2023

(30) Foreign Application Priority Data

Oct. 19, 2022 (TW) ..... 111139596

(51) Int. Cl.

| | |
|---|---|
| ***F21V 33/00*** | (2006.01) |
| ***F21V 23/00*** | (2015.01) |
| ***B68F 1/00*** | (2006.01) |
| ***F21Y 109/00*** | (2016.01) |

(52) U.S. Cl.
CPC ..... *F21V 33/0008* (2013.01); *F21V 23/005* (2013.01); *B68F 1/00* (2013.01); *F21Y 2109/00* (2016.08)

(58) Field of Classification Search
CPC ..... B68F 1/00; F21V 23/004–005; F21V 33/00–0008; F21Y 2109/00
See application file for complete search history.

(56) References Cited

U.S. PATENT DOCUMENTS

2018/0251032 A1* 9/2018 Kang ..... B60K 37/02

* cited by examiner

*Primary Examiner* — Jason M Han
(74) *Attorney, Agent, or Firm* — JCIPRNET

(57) ABSTRACT

A leather workpiece is adapted to emit a light at a surface pattern, and includes a first light-transmitting substrate, a first adhesive layer, a second light-transmitting substrate, a circuit board, and a light-emitting element group. The first adhesive layer is disposed between the first light-transmitting substrate and the second light-transmitting substrate. The circuit board is fixed on the second light-transmitting substrate. The light-emitting element group is disposed on the circuit board and is configured to emit an illumination beam. The first light-transmitting substrate has the surface pattern on a surface opposite to the first adhesive layer. The illumination beam sequentially passes through the first adhesive layer and the surface pattern of the first light-transmitting substrate, so that the leather workpiece emits the light at the surface pattern. A manufacturing method of the leather workpiece is also provided.

26 Claims, 22 Drawing Sheets dispose a third adhesive layer on the second light-transmitting substrate, so that the circuit board is bonded to the second light-transmitting substrate — S160' dispose a third light-transmitting substrate on the light-transmitting intermediate layer, so that bending structures rest on a groove of the third light-transmitting substrate

S170"

FIG. 10C use the line bodies to stitch the first sub-light-transmitting substrate, the first sub-light-transmitting intermediate layer, and the third light-transmitting substrate, and stitch the second sub-light-transmitting substrate, the second sub-light-transmitting intermediate layer, and the third light-transmitting substrate

S112"

FIG. 10D enable multiple second fixing members to pass through the first sub-light-transmitting intermediate layer, the first sub-light-transmitting substrate, the second sub-light-transmitting substrate, and the second sub-light-transmitting intermediate layer at the junction of the bending structures

S180"

FIG. 10E form indentation on a surface of the light-transmitting intermediate layer toward the first adhesive layer, so that the indentations form the surface pattern — S110'''

LEATHER WORKPIECE AND MANUFACTURING METHOD THEREOF

CROSS-REFERENCE TO RELATED APPLICATION

This application claims the priority benefit of Taiwan application serial no. 111139596, filed on Oct. 19, 2022. The entirety of the above-mentioned patent application is hereby incorporated by reference herein and made a part of this specification.

BACKGROUND

Technical Field

The disclosure relates to a leather workpiece and a manufacturing method thereof.

Description of Related Art

Generally speaking, a surface of a leather accessory is relatively monotonous. Therefore, by disposing a reflective sheet or a fluorescent sheet on the surface, specific patterns may be generated on the surface after being illuminated, so as to improve the ornamental properties of the leather accessory. However, the brightness generated by the reflective sheet or the fluorescent sheet is low, and they may not have the light-emitting effect in most environments.

Another improved method to enable the leather accessory to emit a light is to embed LEDs on the surface. However, although the method of embedding the LEDs on the surface improves the brightness of the light, it affects an appearance of the leather accessory, making some consumers unacceptable.

SUMMARY

The disclosure provides a leather workpiece and a manufacturing method thereof, which may simply enable the leather workpiece to emit a light.

An embodiment of the disclosure provides a leather workpiece adapted to emit a light at a surface pattern, including a first light-transmitting substrate, a first adhesive layer, a light-transmitting intermediate layer, a circuit board, and a light-emitting element group. The first adhesive layer is disposed between the first light-transmitting substrate and the second light-transmitting substrate. The light-transmitting intermediate layer is disposed between the first light-transmitting substrate and the first adhesive layer. The first adhesive layer is disposed between the light-transmitting intermediate layer and the second light-transmitting substrate, so that the second light-transmitting substrate is bonded to the light-transmitting intermediate layer. The circuit board is fixed on the second light-transmitting substrate. The light-emitting element group is disposed on the circuit board to emit an illumination beam. The first light-transmitting substrate has the surface pattern on a surface opposite to the first adhesive layer, or the light-transmitting intermediate layer has the surface pattern on a surface toward the first adhesive layer. The illumination beam sequentially passes through the first adhesive layer and the surface pattern of the first light-transmitting substrate, so that the leather workpiece emits the light at the surface pattern.

An embodiment of the disclosure provides a manufacturing method of a leather workpiece including the following.

A light-transmitting intermediate layer is disposed on a first light-transmitting substrate. A first adhesive layer is formed on one side of the light-transmitting intermediate layer opposite to the first light-transmitting substrate, or the first adhesive layer is formed on a second light-transmitting substrate. A fixture is used to fix the first light-transmitting substrate and the light-transmitting intermediate layer, and the second light-transmitting substrate is attached to the light-transmitting intermediate layer through the first adhesive layer. A circuit board is fixed on the second light-transmitting substrate. A light-emitting element group is disposed on the circuit board. An illumination beam emitted by the light-emitting element group sequentially passes through the first adhesive layer and a surface pattern of the first light-transmitting substrate or the light-transmitting intermediate layer, so that the leather workpiece emits a light at the surface pattern. Multiple first fixing members are enabled to pass through the first light-transmitting substrate, the light-transmitting intermediate layer, the first adhesive layer, and the second light-transmitting substrate at a tail end of the leather workpiece away from the surface pattern.

Based on the above, in an embodiment of the disclosure, the line bodies are used for the leather workpiece and the manufacturing method thereof to stitch the first light-transmitting substrate and the light-transmitting intermediate layer, so that the illumination beam emitted by the light-emitting element group may pass through the line apertures and the line bodies, and then enable the leather workpiece to emit the light at the surface pattern. Therefore, the leather workpiece and the manufacturing method thereof may generate the light-emitting effect while maintaining the appearance, and enable the leather workpiece to have better ornamental properties.

BRIEF DESCRIPTION OF THE DRAWINGS

FIGS. 10C to 10E are partial flowcharts of a manufacturing method of the leather workpiece according to the tenth embodiment of the disclosure.

DETAILED DESCRIPTION OF DISCLOSED EMBODIMENTS

Figure 1A:
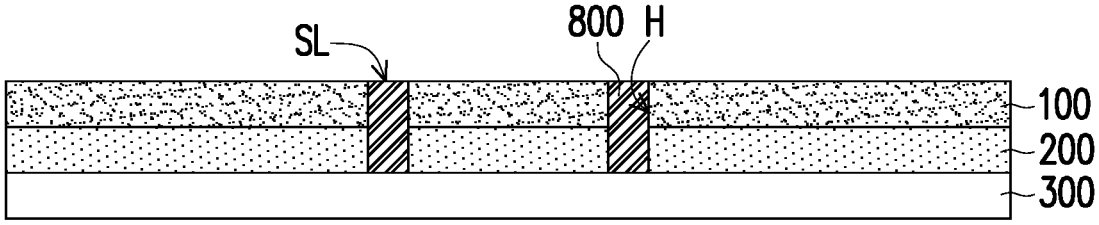
FIGS. 1A to 1E are schematic cross-sectional views of a manufacturing process of a leather workpiece according to the first embodiment of the disclosure.

FIGS. 1A to 1E are schematic cross-sectional views of a manufacturing process of a leather workpiece according to the first embodiment of the disclosure. Referring to FIGS. 1A to 1E, in an embodiment of the disclosure, a leather workpiece 10 adapted to emit a light at a surface pattern SL is provided, including a first light-transmitting substrate 100, a first adhesive layer 300, a second light-transmitting substrate 500, a circuit board 600, and a light-emitting element group 700.

In this embodiment, the first light-transmitting substrate 100 may be light-transmitting polyurethane (PU) leather, poly vinyl chloride (PVC) leather or, genuine leather, but the disclosure is not limited thereto.

In this embodiment, the first adhesive layer 300 is, for example, a water-based transparent adhesive, but the disclosure is not limited thereto.

In this embodiment, a material of the second light-transmitting substrate 500 includes transparent polycarbonate (PC), transparent acrylonitrile butadiene styrene (ABS), transparent poly(methyl methacrylate) (PMMA), translucent polycarbonate, translucent acrylonitrile butadiene styrene, or translucent poly(methyl methacrylate), but the disclosure is not limited thereto.

In this embodiment, the circuit board 600 is, for example, a printed circuit board (PCB) or a flexible printed circuit board (FPC).

In this embodiment, the light-emitting element group 700 is formed by one or more light-emitting diodes (LEDs) or mini light-emitting diodes (MINI LEDs), for example. The light-emitting element group 700 may emit a white light, a red light, a green light, a blue light, or a combination thereof. Light sources in the light-emitting element group 700 may emit the light at the same time or sequentially, for example, to form effects such as a breathing lamp and a water lamp.

In this embodiment, the first adhesive layer 300 is disposed between the first light-transmitting substrate 100 and the second light-transmitting substrate 500. The circuit board 600 is fixed on the second light-transmitting substrate 500. The light-emitting element group 700 is disposed on the circuit board 600 to emit an illumination beam IL. The first light-transmitting substrate 100 has the surface pattern SL on a surface opposite to the first adhesive layer 300 (or the light-transmitting intermediate layer 200 has the surface pattern SL on a surface toward the first adhesive layer 300). The illumination beam IL sequentially passes through the first adhesive layer 300 and the surface pattern SL of the first light-transmitting substrate 100 (or the light-transmitting intermediate layer 200), so that the leather workpiece 10 emits the light at the surface pattern SL.

In this embodiment, the second light-transmitting substrate 500 is C-shaped to form an accommodation space S. The circuit board 600 and the light-emitting element group 700 are disposed in the accommodation space S. The light-emitting element group 700 is disposed on one side of the circuit board 600 facing the surface pattern SL.

In this embodiment, the leather workpiece 10 further includes a light-transmitting intermediate layer 200 and multiple line bodies 800. The light-transmitting intermediate layer 200 may be light-transmitting optical foam or optically transparent silicone, but the disclosure is not limited thereto. The light-transmitting intermediate layer 200 may be disposed to improve a tactile sense of the leather workpiece 10. When the light-transmitting intermediate layer 200 is selected as the optically transparent silicone, high light transmittance of the optically transparent silicone may increase light-emitting intensity of the leather workpiece 10. Therefore, the number of light sources disposed in the light-emitting element group 700 may be reduced, thereby reducing the cost.

In this embodiment, the line body 800 may be cotton thread or nylon fluorescent thread, but the disclosure is not limited thereto.

In this embodiment, the light-transmitting intermediate layer 200 is disposed between the first light-transmitting substrate 100 and the first adhesive layer 300. The first adhesive layer 300 is disposed between the light-transmitting intermediate layer 200 and the second light-transmitting substrate 500, so that the second light-transmitting substrate 500 is bonded to the light-transmitting intermediate layer 200. The first light-transmitting substrate 100 and the light-transmitting intermediate layer 200 have multiple line apertures H. The line bodies 800 pass through the line apertures H to form the surface pattern SL and stitch the first light-transmitting substrate 100 and the light-transmitting intermediate layer 200. That is to say, the surface pattern SL may be a suture formed by the line bodies 800 passing through the line apertures H. After the illumination beam IL is transmitted to the first light-transmitting substrate 100, the illumination beam IL passes through the line apertures H and the line bodies 800, so that the leather workpiece 10 emits the light at the surface pattern SL.

In this embodiment, the leather workpiece 10 further includes a second adhesive layer 400. The second adhesive layer 400 is, for example, a water-based transparent adhesive. The second adhesive layer 400 is bonded on one side of the second light-transmitting substrate 500 facing the light-transmitting intermediate layer 200. The second light-transmitting substrate 500 is bonded to the first adhesive layer 300 through the second adhesive layer 400.

In this embodiment, the leather workpiece 10 further includes multiple columnar structures 900. The column structure 900 is, for example, a screw, a clip, or a latch. The circuit board 600 is fixed on one side of the second light-transmitting substrate 500 opposite to the first light-transmitting substrate 100 through the columnar structures 900. The illumination beam IL first passes through the second light-transmitting substrate 500 and the second adhesive layer 400 to be transmitted to the first adhesive layer 300.

In this embodiment, a portion of the light-transmitting intermediate layer 200 (i.e., a tail end of the light-transmitting intermediate layer 200) is extended and bonded to one side of the second light-transmitting substrate 500 in the accommodation space S through the first adhesive layer 300.

In this embodiment, the leather workpiece 10 further includes multiple first fixing members 1000. The first fixing member 1000 is, for example, a nail. The first fixing members 1000 pass through the first light-transmitting substrate 100, the light-transmitting intermediate layer 200, the first adhesive layer 300, the second adhesive layer 400, and the second light-transmitting substrate 500 at a tail end of the leather workpiece 10 away from the surface pattern SL. Since the leather workpiece 10 is provided with the first fixing members 1000 in a region with a large radian, it may prevent wrinkling or warping, so that the leather workpiece 10 has a better appearance.

Figure 1B:
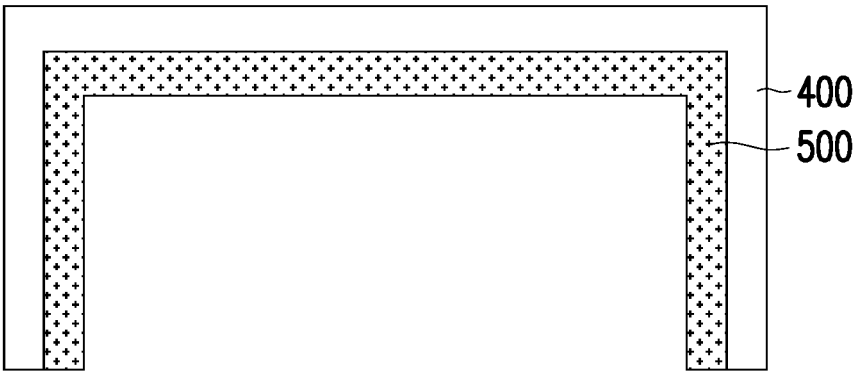
Figure 1C:
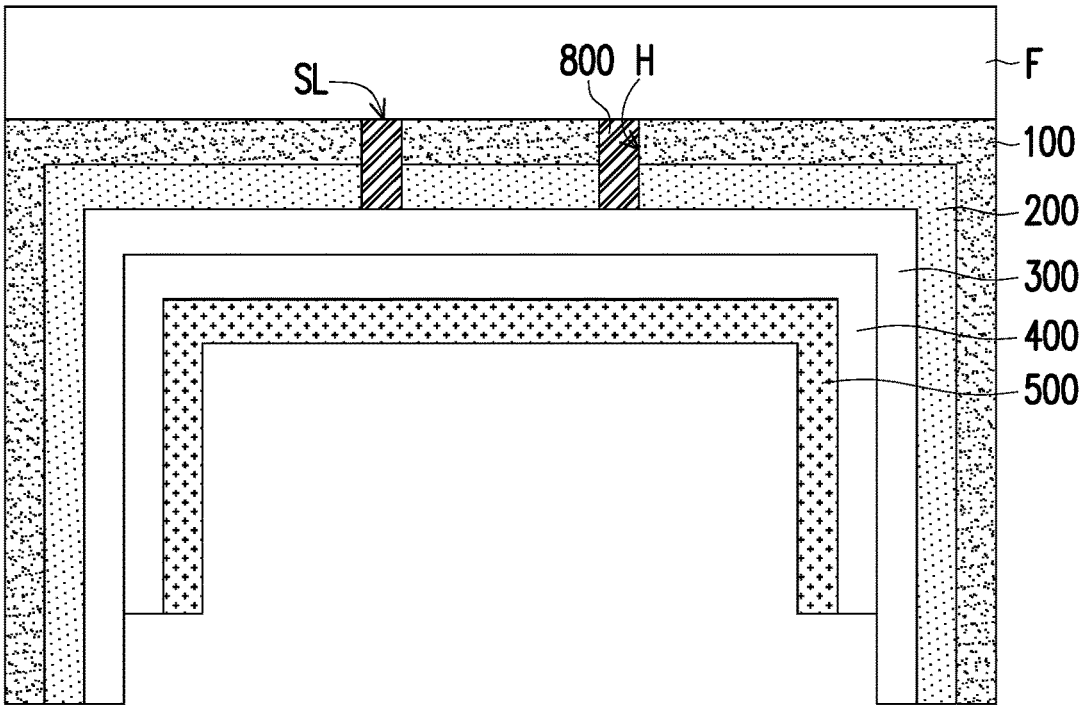
Figure 1D:
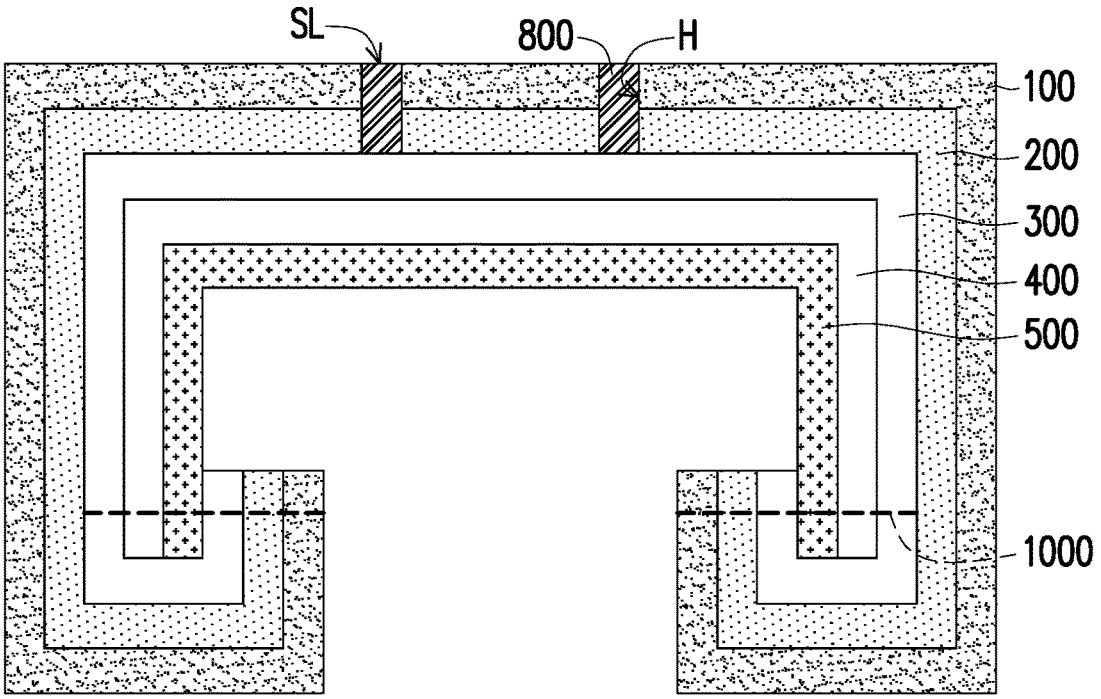
Figure 1E:
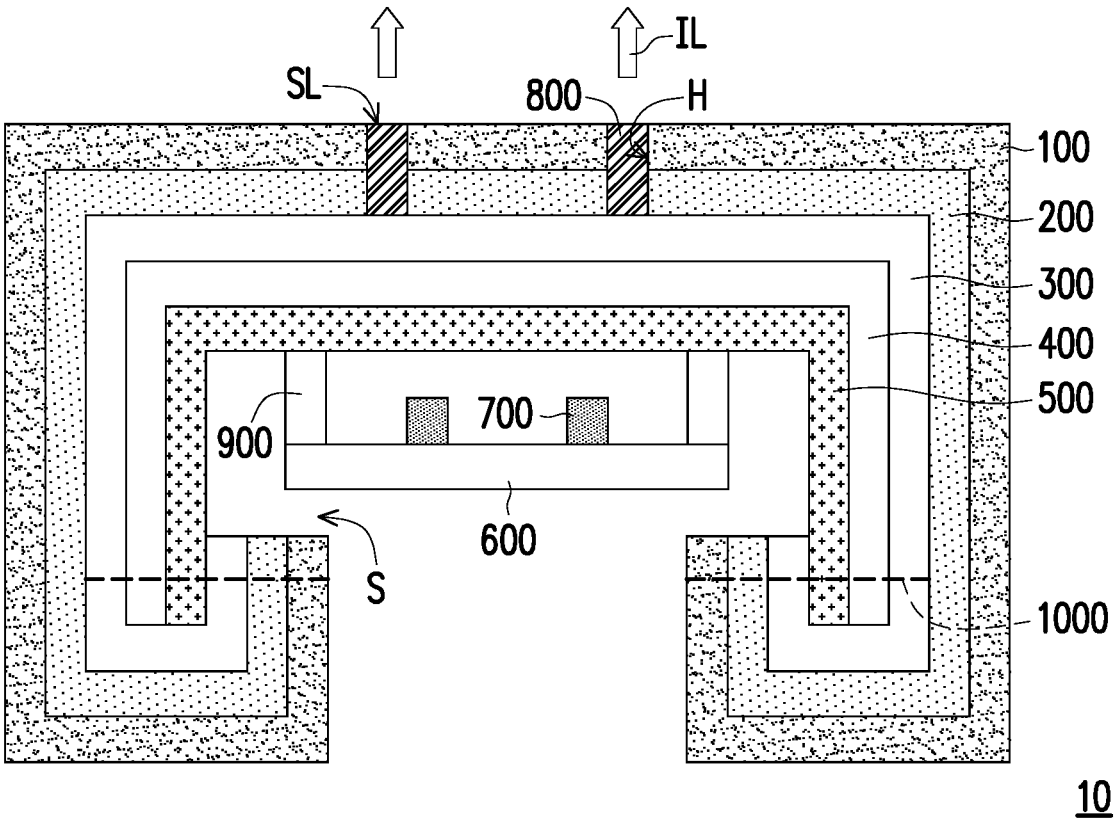
Figure 1F:
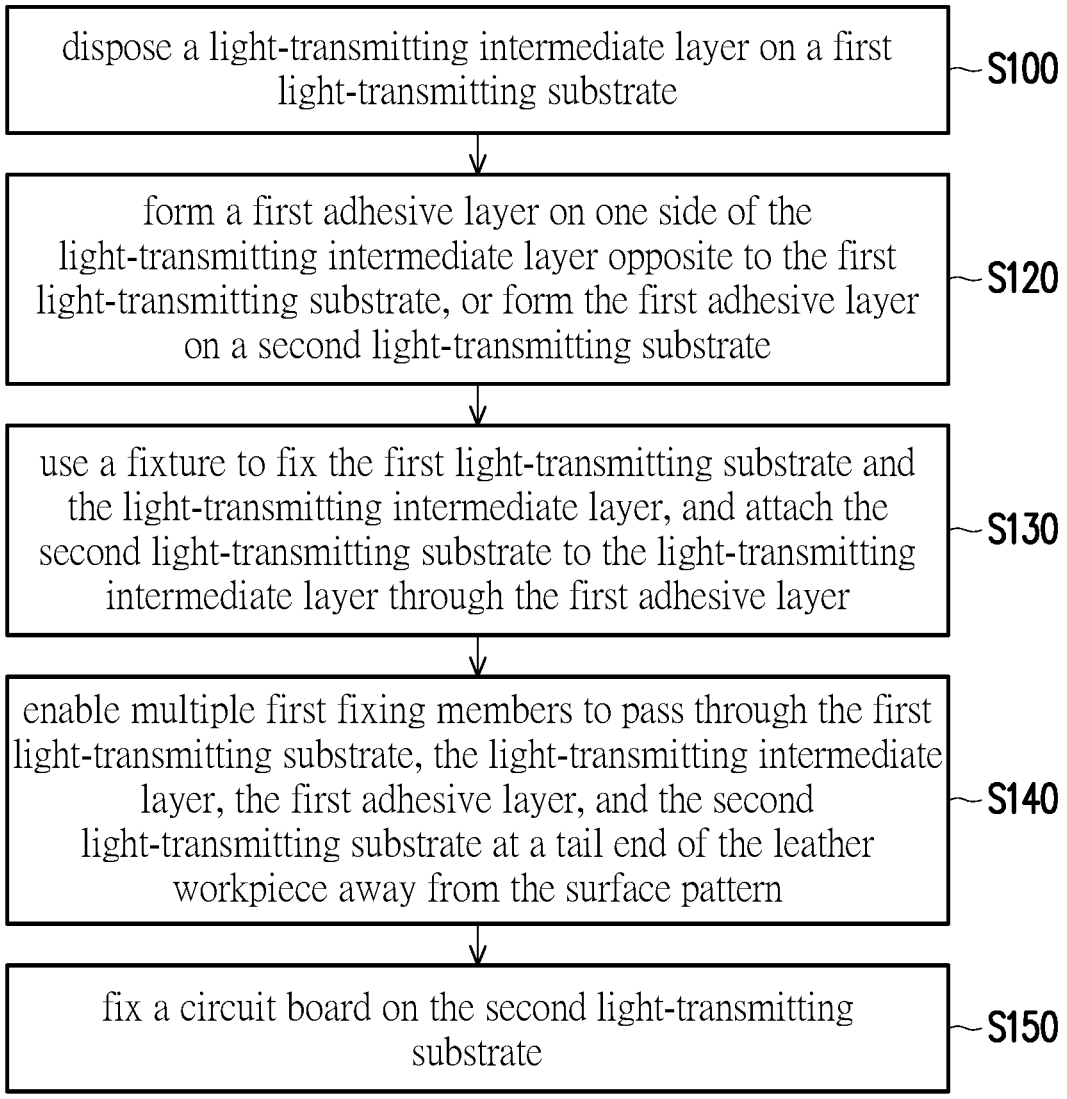
FIGS. 1F to 1I are flowcharts of a manufacturing method of the leather workpiece according to the first embodiment of the disclosure.

FIGS. 1F to 1I are flowcharts of a manufacturing method of the leather workpiece according to the first embodiment of the disclosure. In an embodiment of the disclosure, a manufacturing method of the leather workpiece 10 is provided, which includes the following steps S100 to S150. Referring to FIGS. 1A and 1F first, in step S100, the light-transmitting intermediate layer 200 is disposed on the first light-transmitting substrate 100. After the light-transmitting intermediate layer 200 is attached to the first light-transmitting substrate 100, it is preferable to heat appearance surfaces of the first light-transmitting substrate 100 and the light-transmitting intermediate layer 200 at the same time, so that the following steps S110 to S150 may be easily performed. Next, in step S110, the line bodies 800 are used to stitch the first light-transmitting substrate 100 and the light-transmitting intermediate layer 200. The first light-transmitting substrate 100 and the light-transmitting intermediate layer 200 are stitched to form the line apertures H, and the line bodies 800 pass through the line apertures H to form the surface pattern SL. A method of stitching the first light-transmitting substrate 100 and the light-transmitting intermediate layer 200 is, for example, machine sewing, and the surface pattern SL formed after stitching may have a required pattern. In step S120, the first adhesive layer 300 is formed on one side of the light-transmitting intermediate layer 200 opposite to the first light-transmitting substrate 100, or the first adhesive layer 300 is formed on the second light-transmitting substrate 500 (e.g., FIG. 9). A method of forming the first adhesive layer 300 is, for example, adhesive spraying.

Figure 1G:
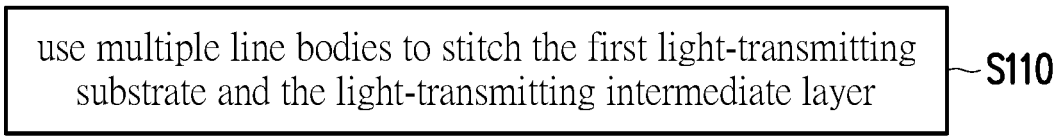
Figure 1H:
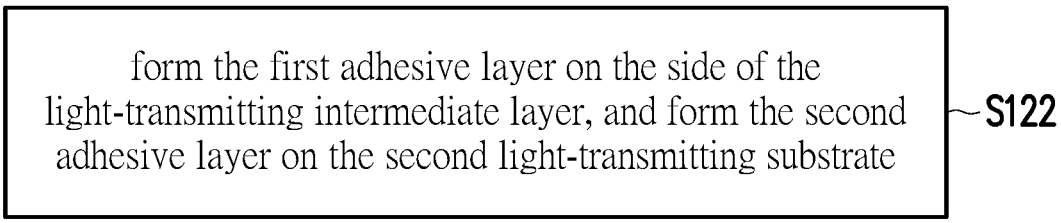
Figure 1I:
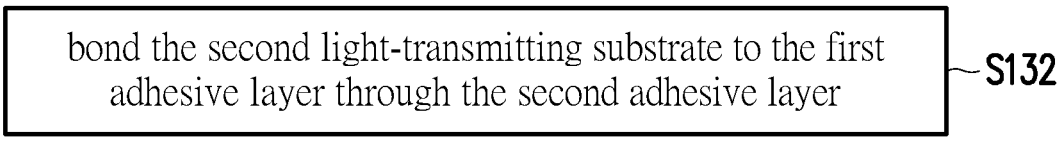

Referring to FIGS. 1A, 1B, and 1G, in this embodiment, step S120 includes the following steps. In step S122, the first adhesive layer 300 is formed on the side of the light-transmitting intermediate layer 200, and the second adhesive layer 400 is formed on the second light-transmitting substrate 500. A method of forming the second adhesive layer 400 is, for example, adhesive spraying. After the first adhesive layer 300 and the second adhesive layer 400 are formed, the first adhesive layer 300 and the second adhesive layer 400 may be heated in an oven before step S130 is performed. A heating temperature and time may be adjusted according to the weather and viscosity of the adhesive layer. For example, the temperature is 65° C. to 75° C., and the heating time is 120 seconds to 240 seconds.

Referring to FIGS. 1C, 1D, and 1F, in step S130 in this embodiment, the first light-transmitting substrate 100 and the light-transmitting intermediate layer 200 are fixed by a fixture F (pressurized), and the second light-transmitting substrate 500 is attached to the light-transmitting intermediate layer 200 through the first adhesive layer 300. In step S140, the first fixing members 1000 pass through the first light-transmitting substrate 100, the light-transmitting intermediate layer 200, and the first adhesive layer 300 at the tail end of the leather workpiece 10 away from the surface pattern SL.

In this embodiment, step S130 includes the following step. In step S132, the second light-transmitting substrate 500 is bonded to the first adhesive layer 300 through the second adhesive layer 400.

Referring to FIGS. 1E and 1F, in step S150 in this embodiment, the circuit board 600 is fixed on the second light-transmitting substrate 500.

Based on the above, in an embodiment of the disclosure, the line bodies 800 are used for the leather workpiece 10 and the manufacturing method thereof to stitch the first light-transmitting substrate 100 and the light-transmitting intermediate layer 200 to form the line apertures H and the surface pattern SL. Then by selecting appropriate materials, the illumination beam IL emitted by the light-emitting element group 700 may pass through the line apertures H and the line bodies 800, and then the leather workpiece 10 emit the light at the surface pattern SL. Therefore, the leather workpiece 10 and the manufacturing method thereof may generate a light-emitting effect while maintaining the appearance, and enable the leather workpiece 10 to have better ornamental properties.

Figure 2:
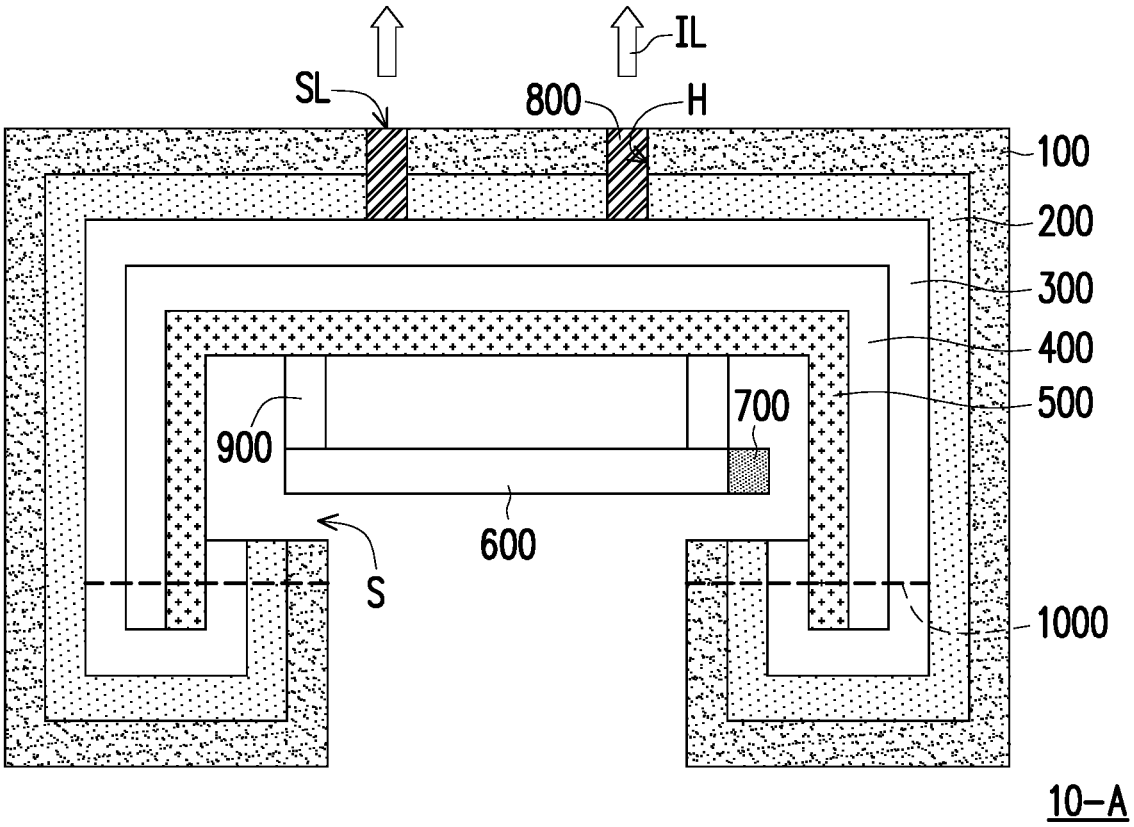
FIG. 2 is a schematic cross-sectional view of a leather workpiece according to the second embodiment of the disclosure.

FIG. 2 is a schematic cross-sectional view of a leather workpiece according to the second embodiment of the disclosure. Referring to FIG. 2, a leather workpiece 10-A is similar to the leather workpiece 10 in FIG. 1E. A main difference is that in this embodiment, the light-emitting element group 700 in the leather workpiece 10-A is disposed on another side of the circuit board 600 perpendicular to one side of the circuit board 600 facing the surface pattern SL. Advantages of the leather workpiece 10-A and a manufacturing method thereof are similar to those of the leather workpiece 10 and the manufacturing method thereof. Therefore, the same details will not be repeated in the following.

Figure 3A:
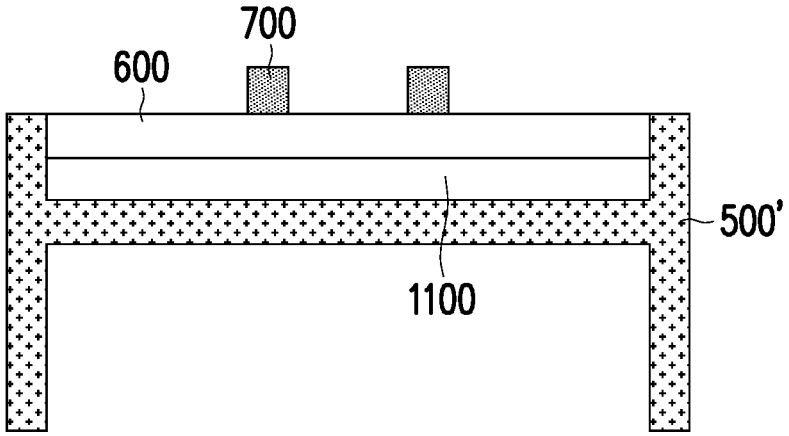
FIGS. 3A to 3B are schematic cross-sectional views of a manufacturing process of a leather workpiece according to the third embodiment of the disclosure.
Figures 3B, 3C:
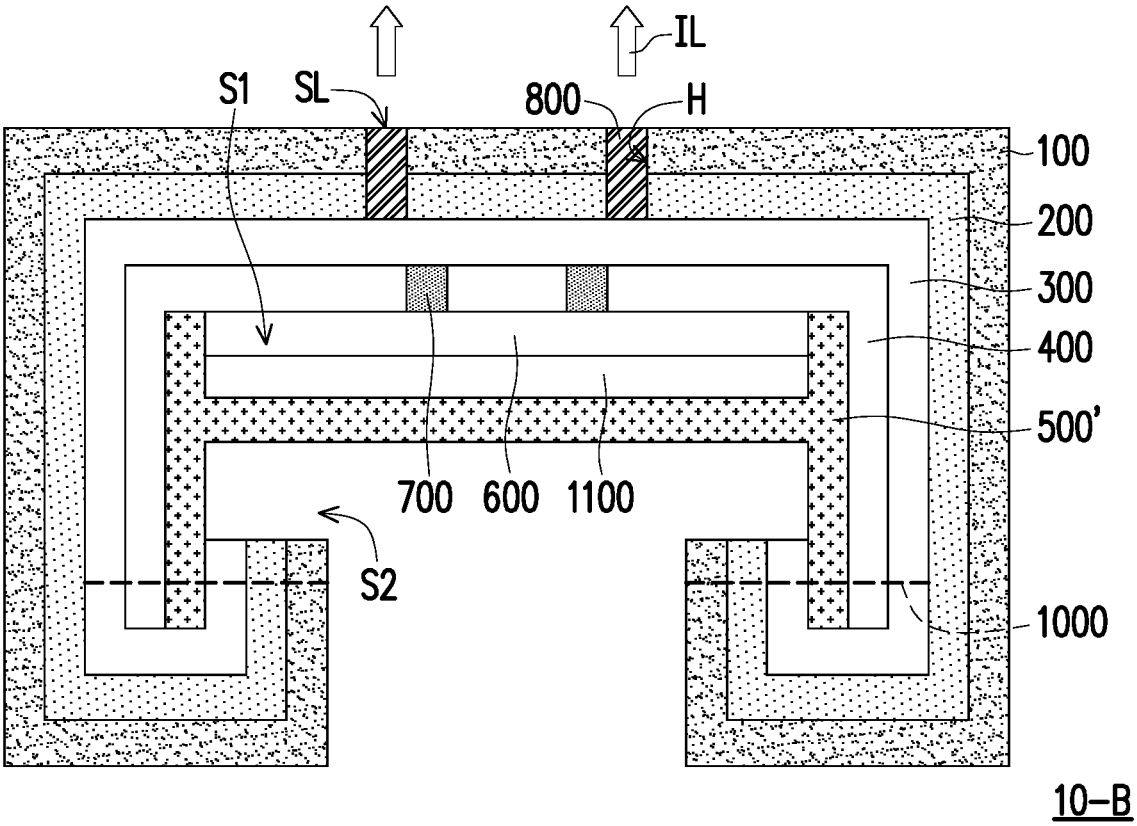
FIG. 3C is a partial flowchart of a manufacturing method of the leather workpiece according to the third embodiment of the disclosure.

FIGS. 3A to 3B are schematic cross-sectional views of a manufacturing process of a leather workpiece according to the third embodiment of the disclosure. Referring to FIGS. 3A to 3B, a leather workpiece 10-B is similar to the leather workpiece 10 in FIG. 1E. A main difference is that in this embodiment, the leather workpiece 10-B further includes a third adhesive layer 1100. The third adhesive layer 1100 is, for example, a water-based transparent adhesive. The third adhesive layer 1100 is disposed between a second light-transmitting substrate 500' and the circuit board 600, so that the circuit board 600 is bonded to the second light-transmitting substrate 500'. The circuit board 600 is fixed on one side of the second light-transmitting substrate 500' facing the light-transmitting intermediate layer 200.

In this embodiment, the second light-transmitting substrate 500' is H-shaped to form two accommodation spaces S1 and S2. The circuit board 600 and the light-emitting element group 700 are disposed in the accommodation space S1 close to the surface pattern SL among the two accommodation spaces S1 and S2.

FIG. 3C is a partial flowchart of a manufacturing method of the leather workpiece according to the third embodiment of the disclosure. Referring to FIGS. 3A and 3C, a manufacturing method of the leather workpiece 10-B in this embodiment further includes the following step. In step S160', the third adhesive layer 1100 is disposed on the second light-transmitting substrate 500', so that the circuit board 600 is bonded to the second light-transmitting substrate 500'. Advantages of the leather workpiece 10-B and the manufacturing method thereof are similar to those of the leather workpiece 10 and the manufacturing method thereof. Therefore, the same details will not be repeated in the following.

Figure 4:
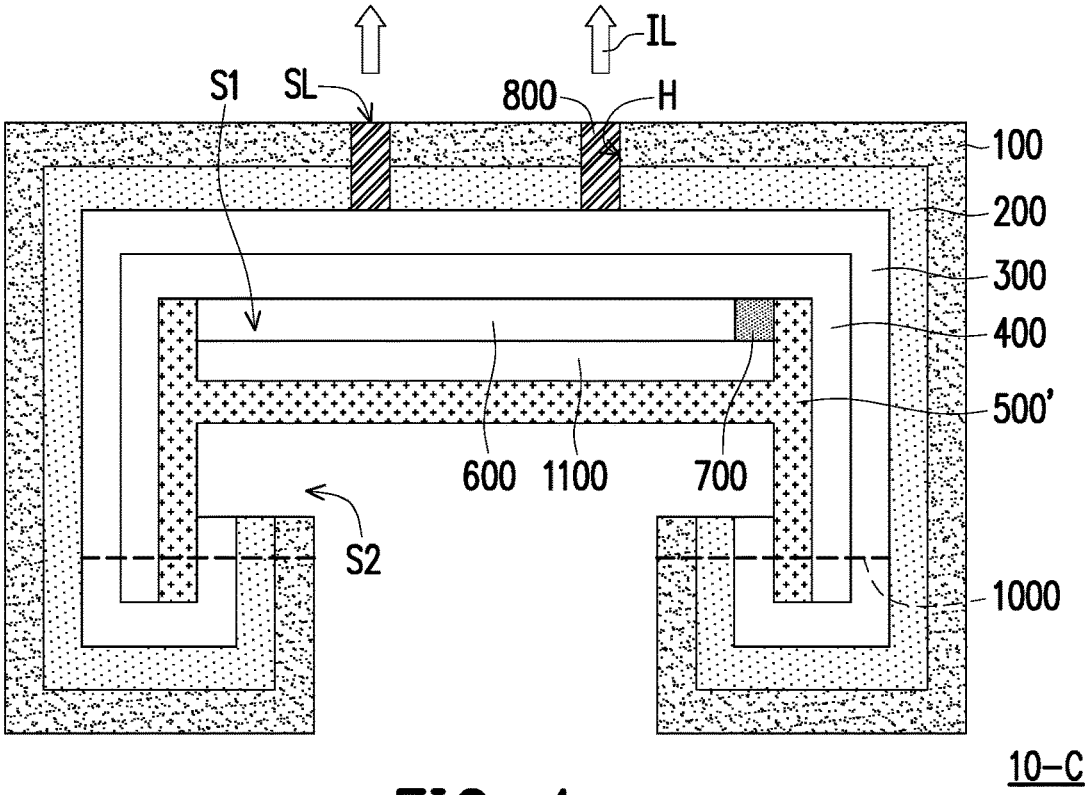
FIG. 4 is a schematic cross-sectional view of a leather workpiece according to the fourth embodiment of the disclosure.

FIG. 4 is a schematic cross-sectional view of a leather workpiece according to the fourth embodiment of the disclosure. Referring to FIG. 4, a leather workpiece 10-C is similar to the leather workpiece 10-B in FIG. 3B. A main difference is that in this embodiment, the light-emitting element group 700 is disposed on the another side of the circuit board 600 perpendicular to the one side of the circuit board 600 facing the surface pattern SL. Advantages of the leather workpiece 10-C and a manufacturing method thereof are similar to those of the leather workpiece 10-B and the manufacturing method thereof. Therefore, the same details will not be repeated in the following.

Figure 5:
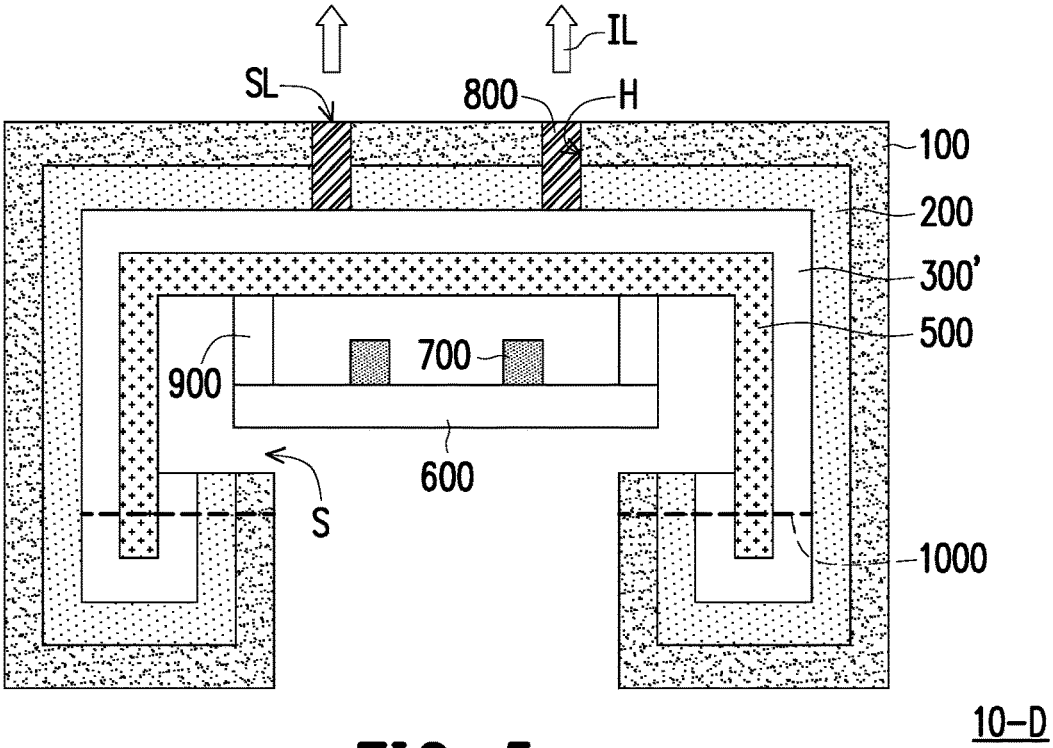
FIG. 5 is a schematic cross-sectional view of a leather workpiece according to the fifth embodiment of the disclosure.

FIG. 5 is a schematic cross-sectional view of a leather workpiece according to the fifth embodiment of the disclosure. Referring to FIG. 5, a leather workpiece 10-D is similar to the leather workpiece 10 in FIG. 1E. A main difference is that in this embodiment, a first adhesive layer 300' is a light-transmitting double-sided adhesive. That is to say, by using the first adhesive layer 300' as the light-transmitting double-sided adhesive, the second adhesive layer 400 in the leather workpiece 10 is omitted from the leather workpiece 10-D. Therefore, a process may be reduced, thereby reducing the cost. Remaining advantages of the leather workpiece 10-D and a manufacturing method thereof are similar to those of the leather workpiece 10 and the manufacturing method thereof. Therefore, the same details will not be repeated in the following.

Figure 6:
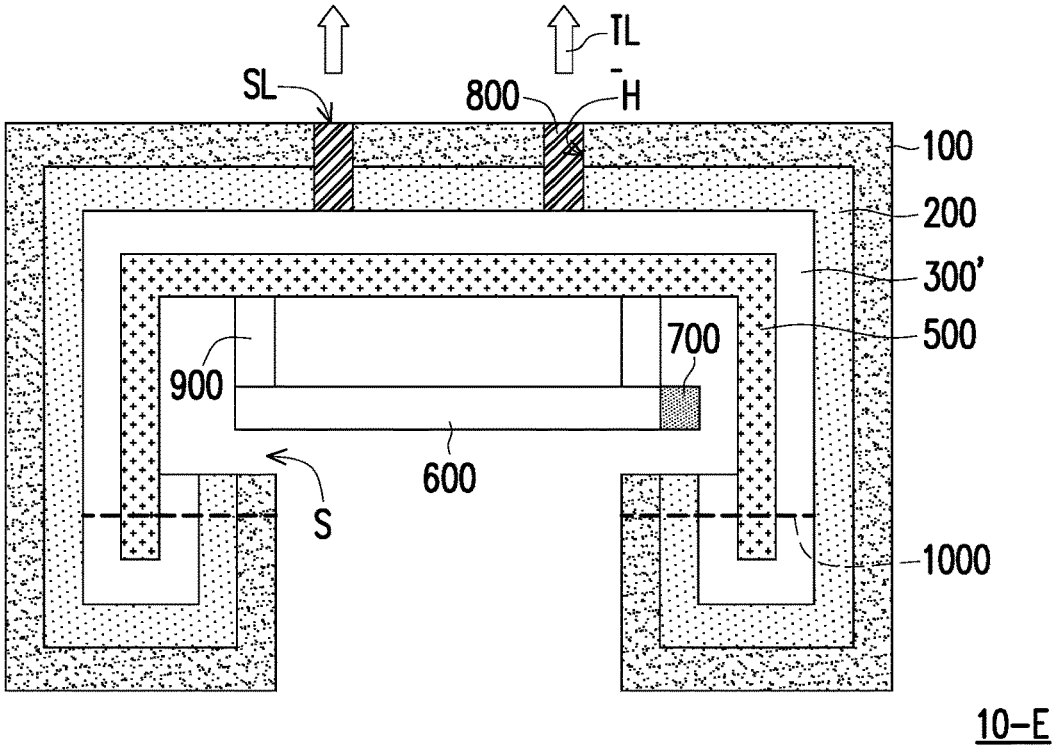
FIG. 6 is a schematic cross-sectional view of a leather workpiece according to the sixth embodiment of the disclosure.

FIG. 6 is a schematic cross-sectional view of a leather workpiece according to the sixth embodiment of the disclosure. Referring to FIG. 6, a leather workpiece 10-E is similar to the leather workpiece 10-D in FIG. 5. A main difference is that in this embodiment, the light-emitting element group 700 in the leather workpiece 10-E is disposed on the another side of the circuit board 600 perpendicular to the one side of the circuit board 600 facing the surface pattern SL. Advantages of the leather workpiece 10-E and a manufacturing method thereof are similar to those of the leather workpiece 10-D and the manufacturing method thereof. Therefore, the same details will not be repeated in the following.

Figure 7:
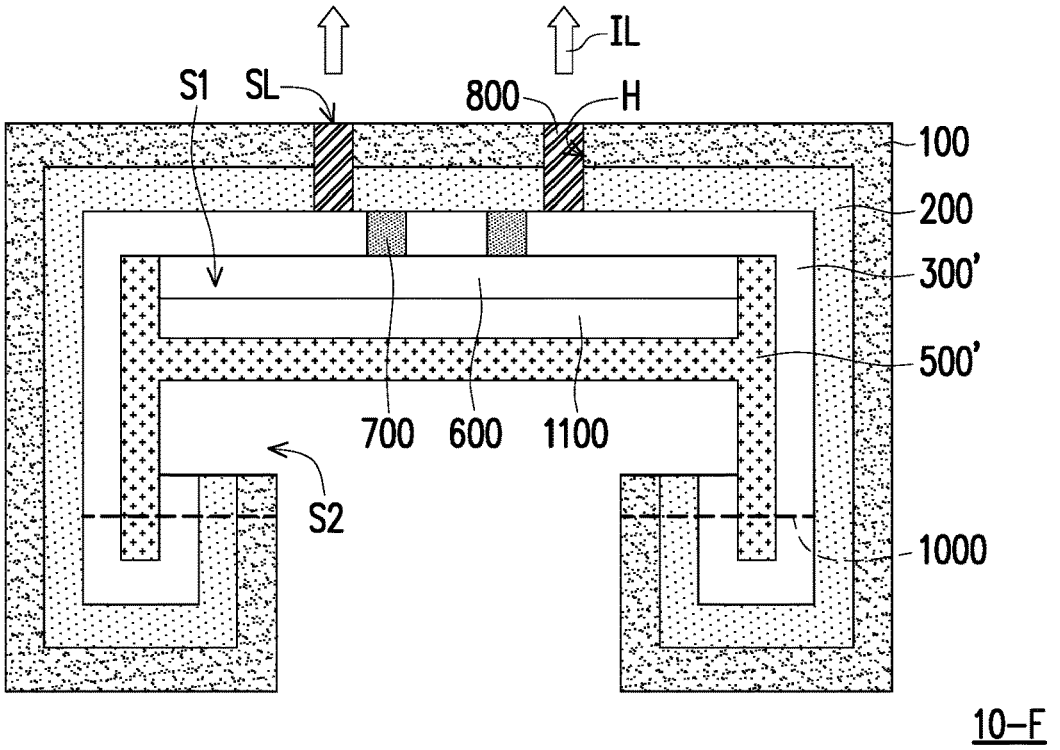
FIG. 7 is a schematic cross-sectional view of a leather workpiece according to the seventh embodiment of the disclosure.

FIG. 7 is a schematic cross-sectional view of a leather workpiece according to the seventh embodiment of the disclosure. Referring to FIG. 7, a leather workpiece 10-F is similar to the leather workpiece 10-D in FIG. 5. A main difference is that in this embodiment, the leather workpiece 10-F further includes the third adhesive layer 1100. The third adhesive layer 1100 is disposed between the second light-transmitting substrate 500' and the circuit board 600, so that the circuit board 600 is bonded to the second light-transmitting substrate 500'. The circuit board 600 is fixed on the side of the second light-transmitting substrate 500' facing the light-transmitting intermediate layer 200. Advantages of the leather workpiece 10-F and a manufacturing method thereof are similar to those of the leather workpiece 10-D and the manufacturing method thereof. Therefore, the same details will not be repeated in the following.

Figure 8:
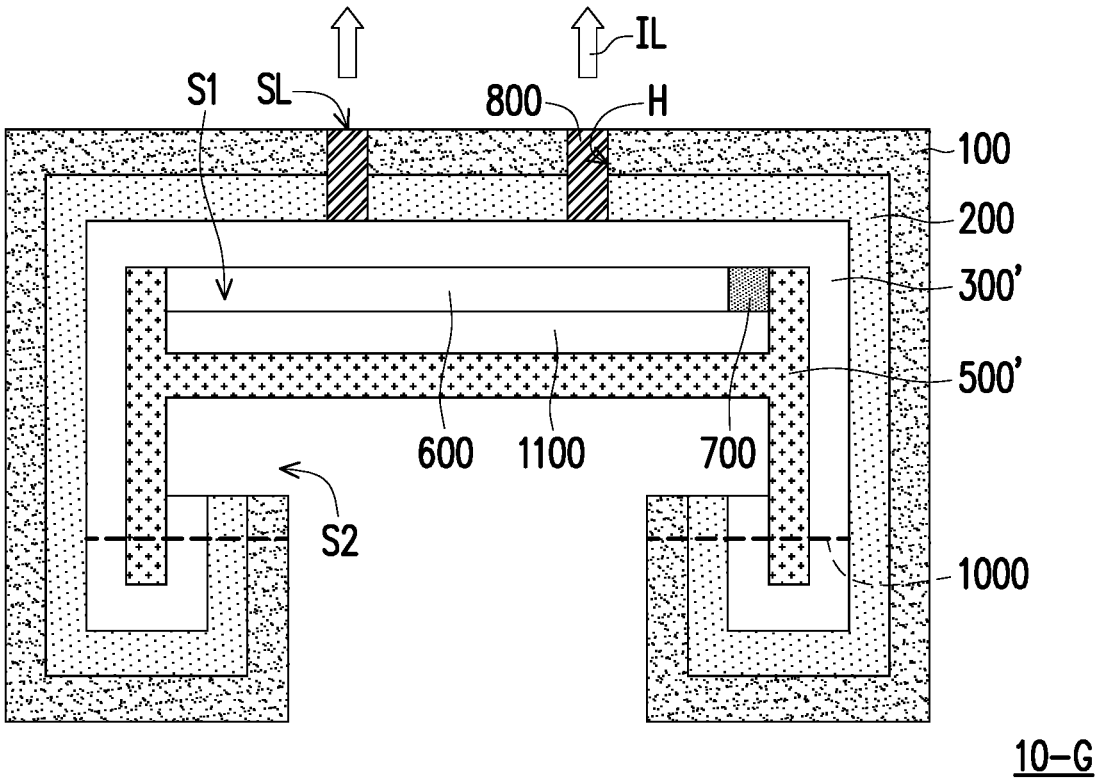
FIG. 8 is a schematic cross-sectional view of a leather workpiece according to the eighth embodiment of the disclosure.

FIG. 8 is a schematic cross-sectional view of a leather workpiece according to the eighth embodiment of the disclosure. Referring to FIG. 8, a leather workpiece 10-G is similar to the leather workpiece 10-F in FIG. 7. A main difference is that the light emitting element group 700 is disposed on the another side of the circuit board 600 perpendicular to the one side of the circuit board 600 facing the surface pattern SL. Advantages of the leather workpiece 10-G and a manufacturing method thereof are similar to those of the leather workpiece 10-F and the manufacturing method thereof. Therefore, the same details will not be repeated in the following.

Figure 9:
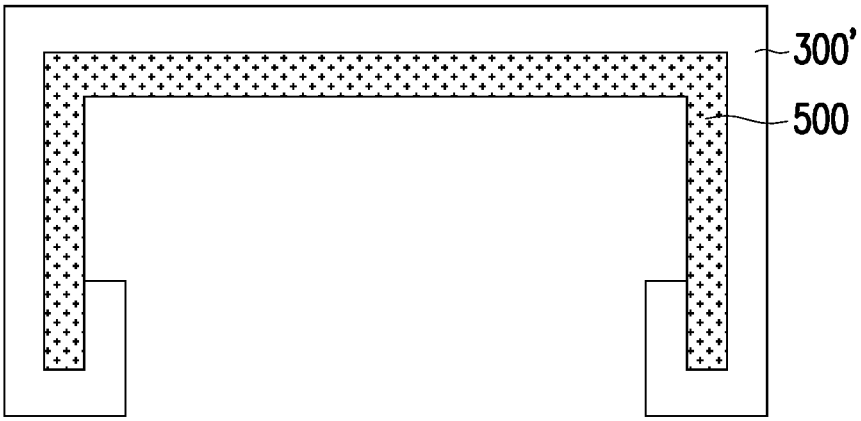
FIG. 9 is a schematic cross-sectional view of one of manufacturing processes of a leather workpiece according to the ninth embodiment of the disclosure.

FIG. 9 is a schematic cross-sectional view of one of manufacturing processes of a leather workpiece according to the ninth embodiment of the disclosure. Referring to FIG. 9, the leather workpiece and a manufacturing method thereof in this embodiment are similar to those shown in FIGS. 5 to 8. A main difference is that in step S120, the first adhesive layer 300' is formed on the second light-transmitting substrate 500. The first adhesive layer 300' is the light-transmitting double-sided adhesive. Advantages of the leather workpiece and the manufacturing method thereof in this embodiment are similar to those of the leather workpieces 10-D to 10-F and the manufacturing methods thereof. Therefore, the same details will not be repeated in the following.

Figure 10A:
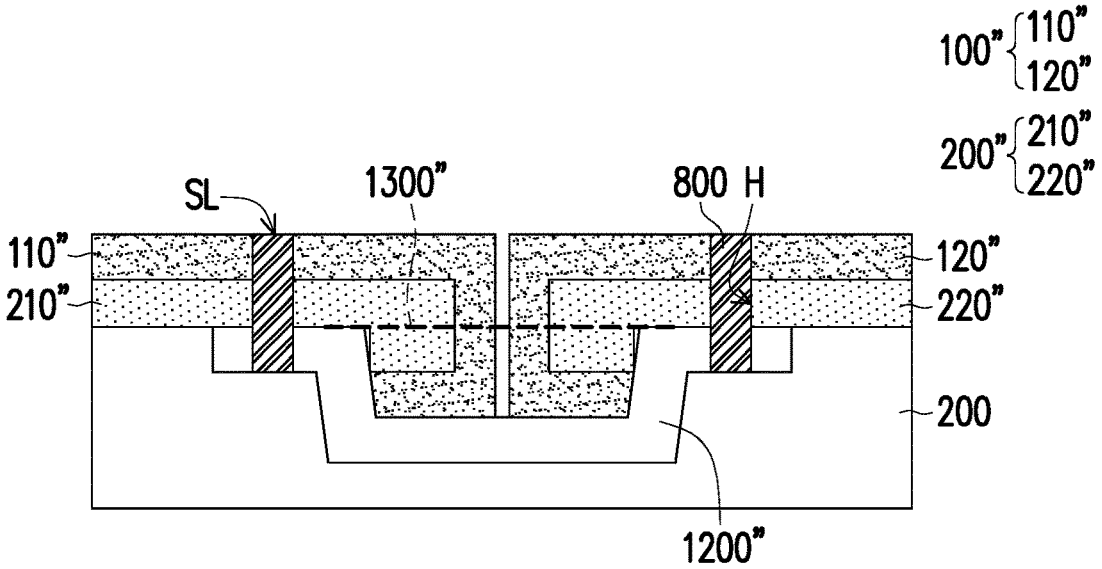
FIGS. 10A to 10B are schematic cross-sectional views of a manufacturing process of a leather workpiece according to the tenth embodiment of the disclosure.
Figure 10B:
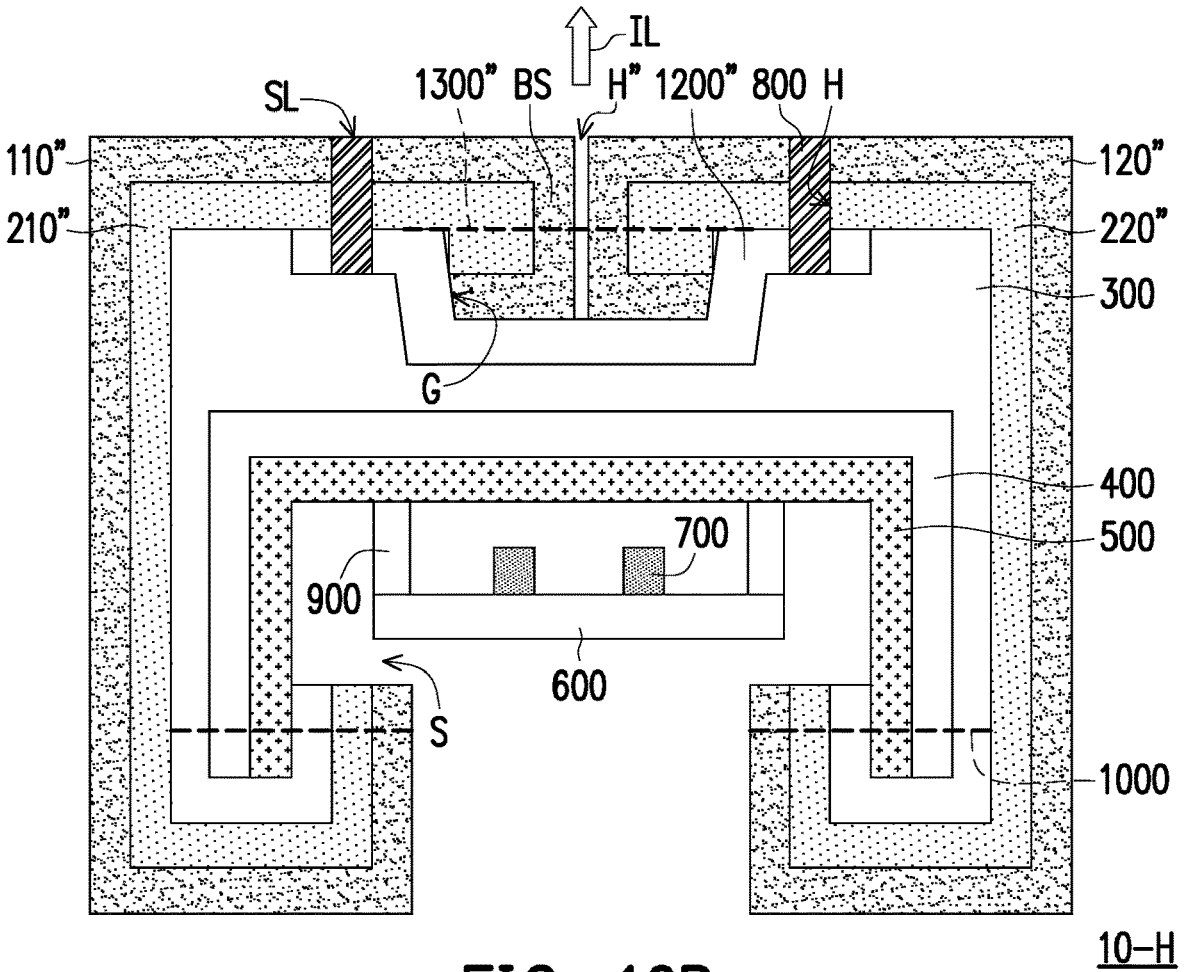

FIGS. 10A to 10B are schematic cross-sectional views of a manufacturing process of a leather workpiece according to the tenth embodiment of the disclosure. Referring to FIGS. 10A to 10B, a leather workpiece 10-H is similar to the leather workpiece 10 in FIG. 1E. A main difference is that in this embodiment, the leather workpiece 10-H further includes a third light-transmitting substrate 1200". A material of the third light-transmitting substrate 1200" include translucent polycarbonate, translucent poly(methyl methacrylate), translucent thermoplastic polyurethane (TPU), translucent thermoplastic polyolefin (TPO), translucent acrylonitrile butadiene styrene, or translucent poly propylene carbonate (PPC), but the disclosure is not limited thereto.

In this embodiment, a first light-transmitting substrate 100" includes a first sub-light-transmitting substrate 110" and a second sub-light-transmitting substrate 120". A light-transmitting intermediate layer 200" includes a first sub-light-transmitting intermediate layer 210" and a second sub-light-transmitting intermediate layer 220". The third light-transmitting substrate 1200" has a groove G on one side facing the first light-transmitting substrate 100". The light-transmitting intermediate layer 200" is disposed between the first light-transmitting substrate 100" and the third light-transmitting substrate 1200". The first sub-light-transmitting substrate 110" and the second sub-light-transmitting substrate 120" respectively have bending structures BS close to a tail end of the surface pattern SL. The bending structures BS rest on the groove G of the third light-transmitting substrate 1200" to fix a distance between the first sub-light-transmitting substrate 110" and the second sub-light-transmitting substrate 120", avoiding an uneven pattern formed by a light-transmitting hole H".

In this embodiment, the first sub-light-transmitting substrate 110", the second sub-light-transmitting substrate 120", the first sub-light-transmitting intermediate layer 210", the second sub-light-transmitting intermediate layer 220", and the third light-transmitting substrate 1200" has the line apertures H. The line bodies 800 pass through the line apertures H to form the surface pattern SL and stitch the first sub-light-transmitting substrate 110", the first sub-light-transmitting intermediate layer 210", and the third light-transmitting substrate 1200", and stitch the second sub-light-transmitting substrate 120", the second sub-light-transmitting intermediate layer 220", and the third light-transmitting substrate 1200". The light-transmitting hole H" is formed at a junction of the bending structures BS. The illumination beam IL sequentially passes through the first adhesive layer 300, the line apertures H, and the line bodies 800, so that the leather workpiece 10-H emits the light at the surface pattern SL, or sequentially passes through the first adhesive layer 300, the third light-transmitting substrate 1200", and the light-transmitting hole H", so that the leather workpiece 10-H emits the light at the light-transmitting hole H".

In this embodiment, the leather workpiece 10-H further includes multiple second fixing members 1300". The second fixing member 1300" is, for example, a nail. The second fixing member 1300" passes through the first sub-light-transmitting substrate 110", the first sub-light-transmitting intermediate layer 210", the second sub-light-transmitting substrate 120", and the second sub-light-transmitting intermediate layer 220" at the junction of the bending structures BS.

FIGS. 10C to 10E are partial flowcharts of a manufacturing method of the leather workpiece according to the tenth embodiment of the disclosure. Referring to FIGS. 10A and 10C first, a manufacturing method of the leather workpiece 10-H in the embodiment of the disclosure further includes the following step. In step S170", the third light-transmitting substrate 1200" is disposed on the light-transmitting intermediate layer 200, so that the bending structures BS rest on the groove G of the third light-transmitting substrate 1200".

Referring to FIGS. 10A and 10D, in this embodiment, step S110 includes the following step. In step S112", the line bodies 800 are used to stitch the first sub-light-transmitting substrate 110", the first sub-light-transmitting intermediate layer 210", and the third light-transmitting substrate 1200", and stitch the second sub-light-transmitting substrate 120", the second sub-light-transmitting intermediate layer 220", and the third light-transmitting substrate 1200".

Referring to FIGS. 10A and 10E, in this embodiment, the manufacturing method of the leather workpiece 10-H further includes the following step. In step S180", the second fixing members 1300" pass through the first sub-light-transmitting intermediate layer 210", the first sub-light-transmitting substrate 110", the second sub-light-transmitting substrate 120", and the second sub-light-transmitting intermediate layer 220" at the junction of the bending structures BS.

Based on the above, in an embodiment of the disclosure, the first sub-light-transmitting substrate 110" and the second sub-light-transmitting substrate 120" of the leather workpiece 10-H respectively have the bending structures BS close to the tail end of the surface pattern SL, and the light-transmitting hole H" is formed at the junction of the bending structures BS, so that the leather workpiece 10-H may emit the light at the light-transmitting hole H". Remaining advantages of the leather workpiece 10-H and the manufacturing method thereof are similar to those of the leather workpiece 10 and the manufacturing method thereof. Therefore, the same details will not be repeated in the following.

Figure 11:
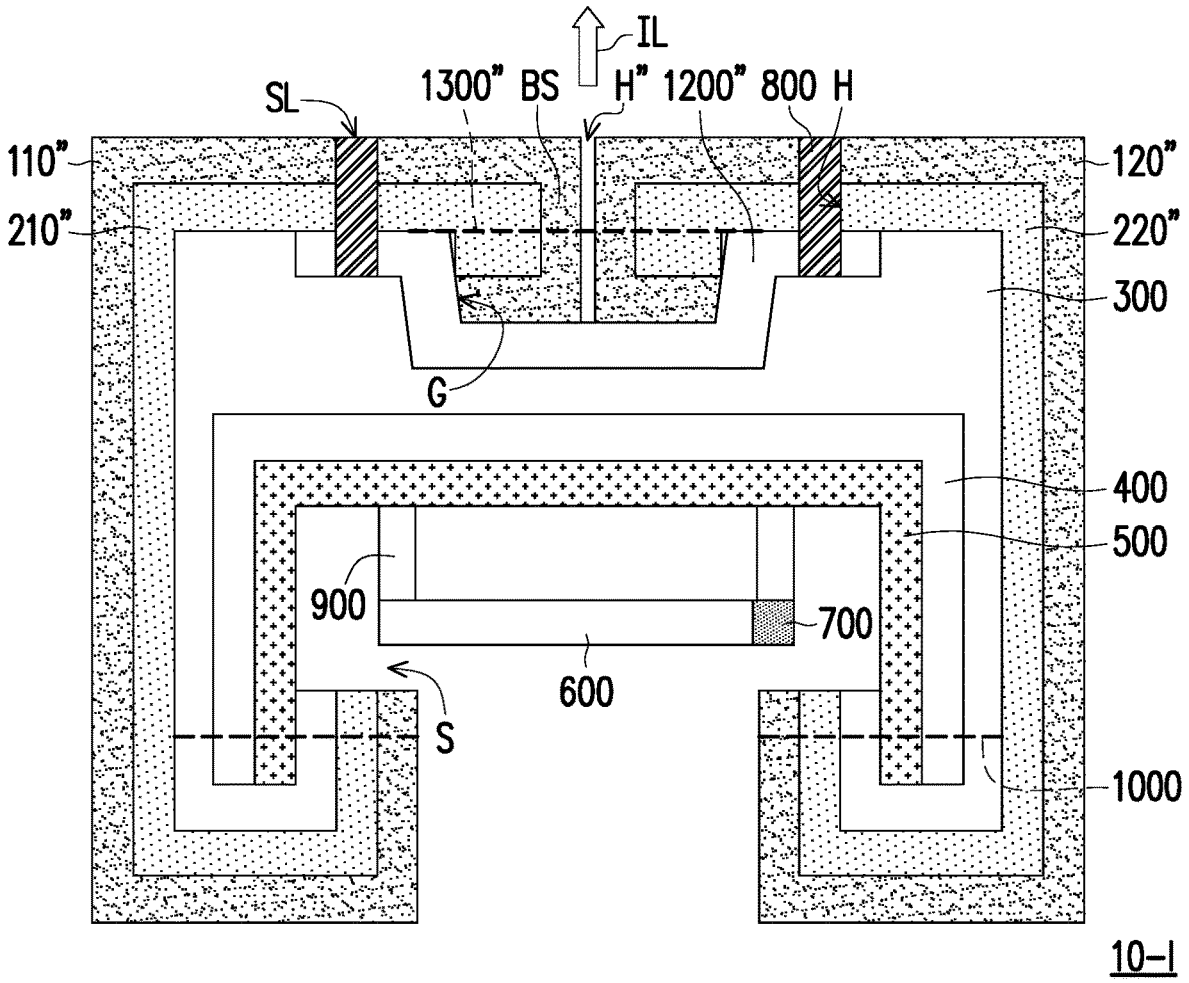
FIG. 11 is a schematic cross-sectional view of a leather workpiece according to the eleventh embodiment of the disclosure.

FIG. 11 is a schematic cross-sectional view of a leather workpiece according to the eleventh embodiment of the disclosure. Referring to FIG. 11, a leather workpiece 10-I is similar to the leather workpiece 10-H in FIG. 10B. A main difference is that in this embodiment, the light-emitting element group 700 in the leather workpiece 10-I is disposed on the another side of the circuit board 600 perpendicular to the one side of the circuit board 600 facing the surface pattern SL. Advantages of the leather workpiece 10-I and a manufacturing method thereof are similar to those of the leather workpiece 10-H and the manufacturing method thereof. Therefore, the same details will not be repeated in the following.

Figure 12:
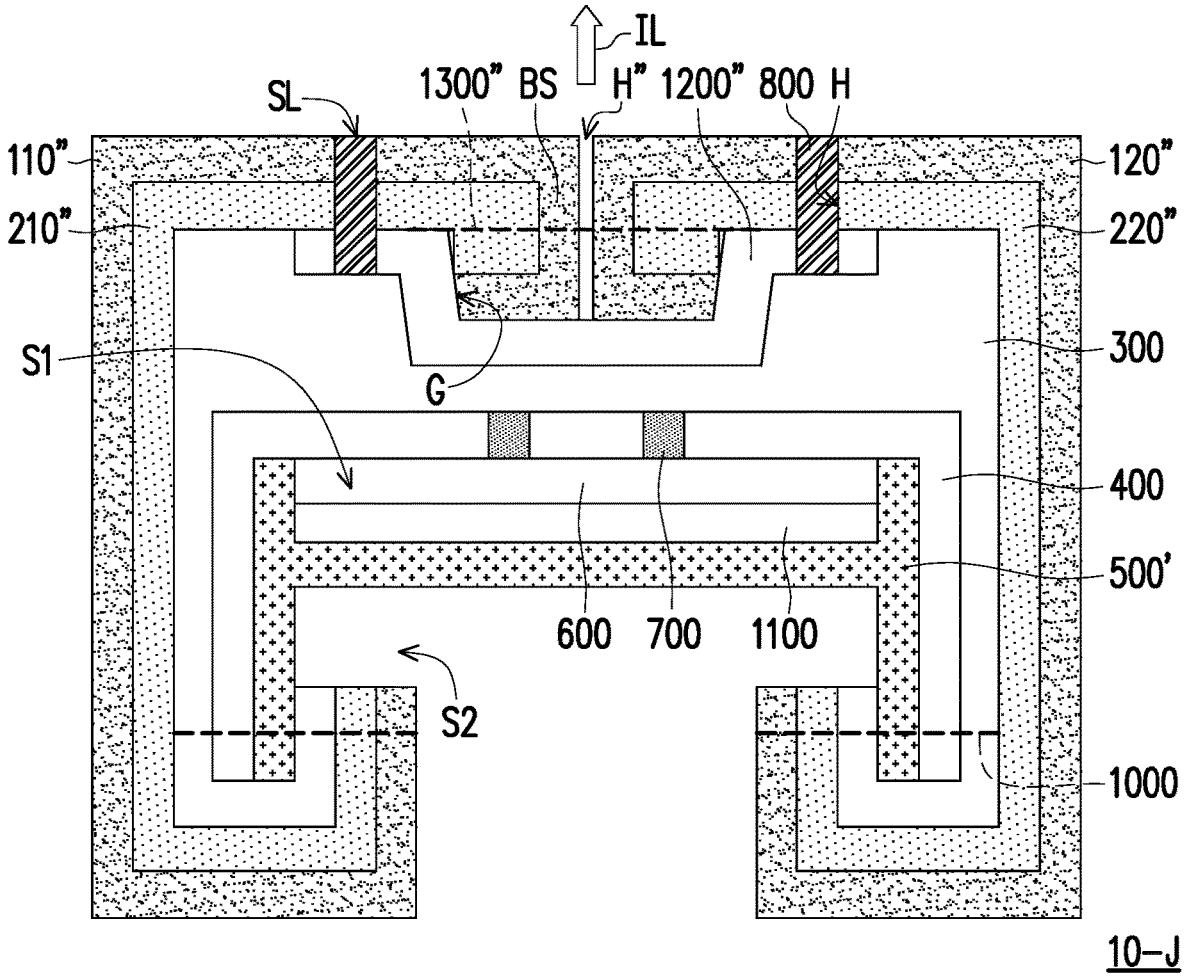
FIG. 12 is a schematic cross-sectional view of a leather workpiece according to the twelfth embodiment of the disclosure.

FIG. 12 is a schematic cross-sectional view of a leather workpiece according to the twelfth embodiment of the disclosure. Referring to FIG. 12, a leather workpiece 10-J is similar to the leather workpiece 10-H in FIG. 10B. A main difference is that in this embodiment, the leather workpiece 10-J further includes the third adhesive layer 1100. The third adhesive layer 1100 is disposed between the second light-transmitting substrate 500' and the circuit board 600, so that the circuit board 600 is bonded to the second light-transmitting substrate 500'. The circuit board 600 is fixed on the side of the second light-transmitting substrate 500' facing the light-transmitting intermediate layer 200. Advantages of the leather workpiece 10-J and a manufacturing method thereof are similar to those of the leather workpiece 10-H and the manufacturing method thereof. Therefore, the same details will not be repeated in the following.

Figure 13:
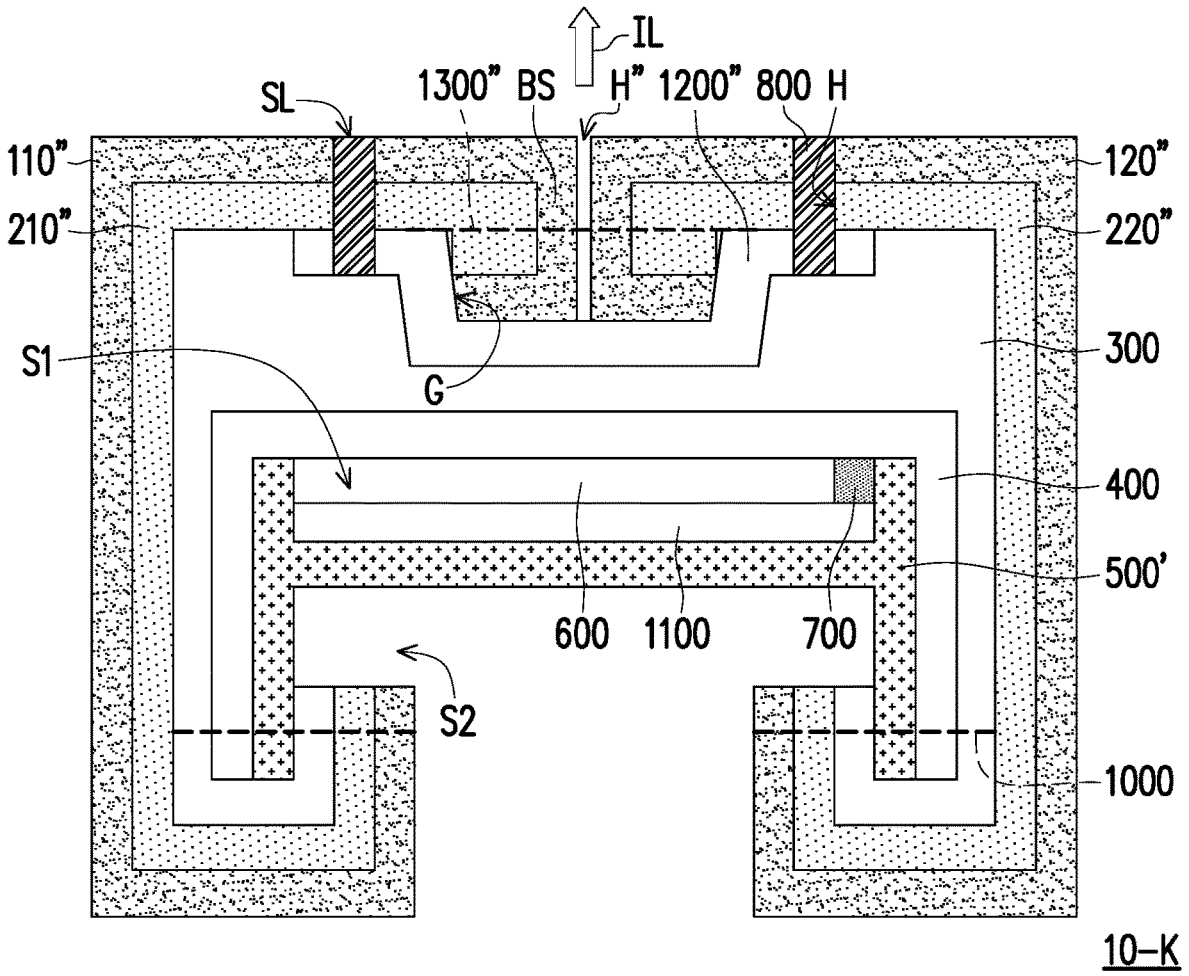
FIG. 13 is a schematic cross-sectional view of a leather workpiece according to the thirteenth embodiment of the disclosure.

FIG. 13 is a schematic cross-sectional view of a leather workpiece according to the thirteenth embodiment of the disclosure. Referring to FIG. 13, in this embodiment, a leather workpiece 10-K is similar to the leather workpiece 10-J in FIG. 12. A main difference is that the light-emitting element group 700 is disposed on the another side of the circuit board 600 perpendicular to the one side of the circuit board 600 facing the surface pattern SL. Advantages of the leather workpiece 10-K and a manufacturing method thereof are similar to those of the leather workpiece 10-J and the manufacturing method thereof. Therefore, the same details will not be repeated in the following.

Figure 14:
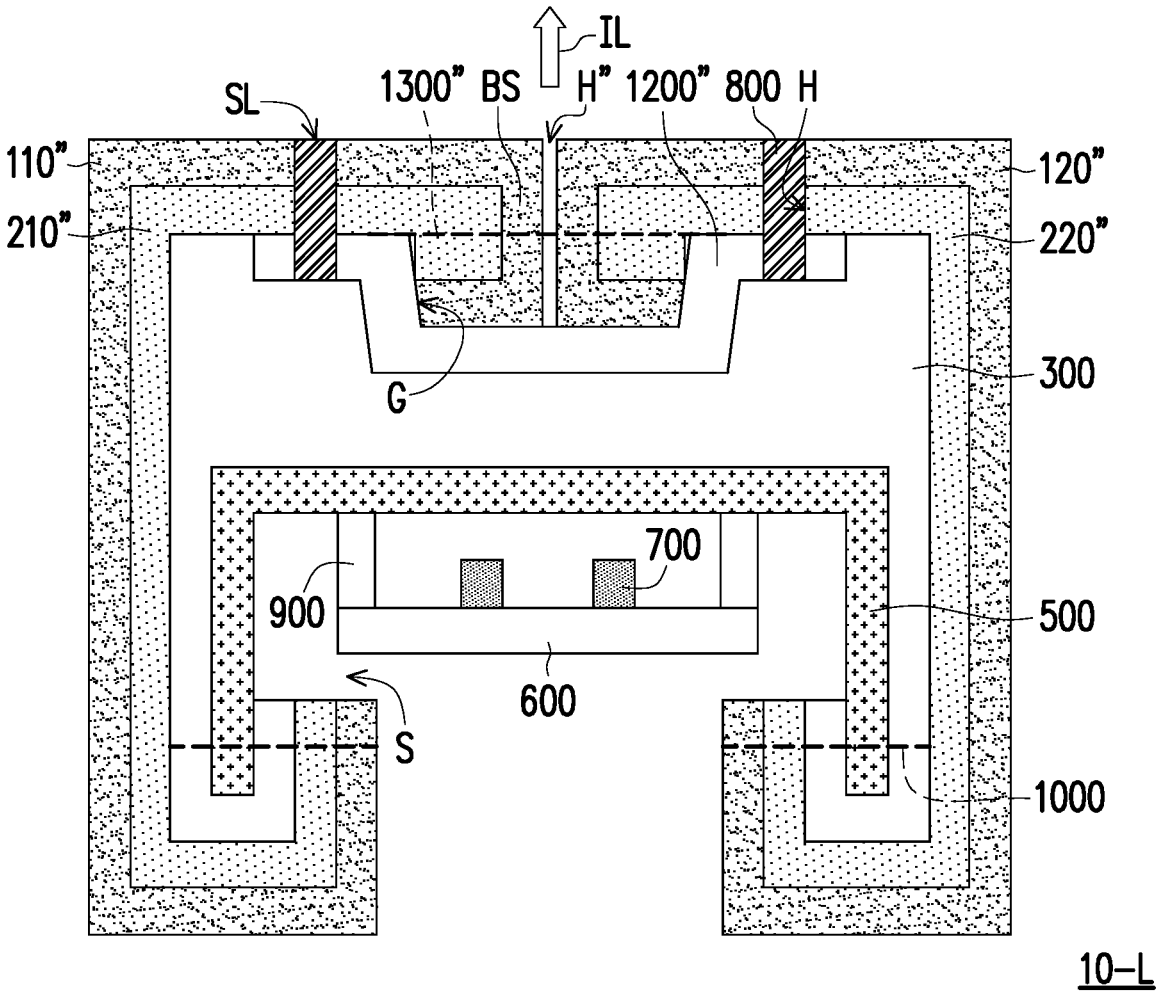
FIG. 14 is a schematic cross-sectional view of a leather workpiece according to the fourteenth embodiment of the disclosure.

FIG. 14 is a schematic cross-sectional view of a leather workpiece according to the fourteenth embodiment of the disclosure. Referring to FIG. 14, a leather workpiece 10-L is similar to the leather workpiece 10-H in FIG. 10B. A main difference is that in this embodiment, the first adhesive layer 300' is the light-transmitting double-sided adhesive. That is to say, by using the first adhesive layer 300' as the light-transmitting double-sided adhesive, the second adhesive layer 400 in the workpiece 10-H is omitted from the leather workpiece 10-L. Therefore, a process may be reduced, thereby reducing the cost. Remaining advantages of the leather workpiece 10-L and a manufacturing method thereof are similar to those of the leather workpiece 10-H and the manufacturing method thereof. Therefore, the same details will not be repeated in the following.

Figure 15:
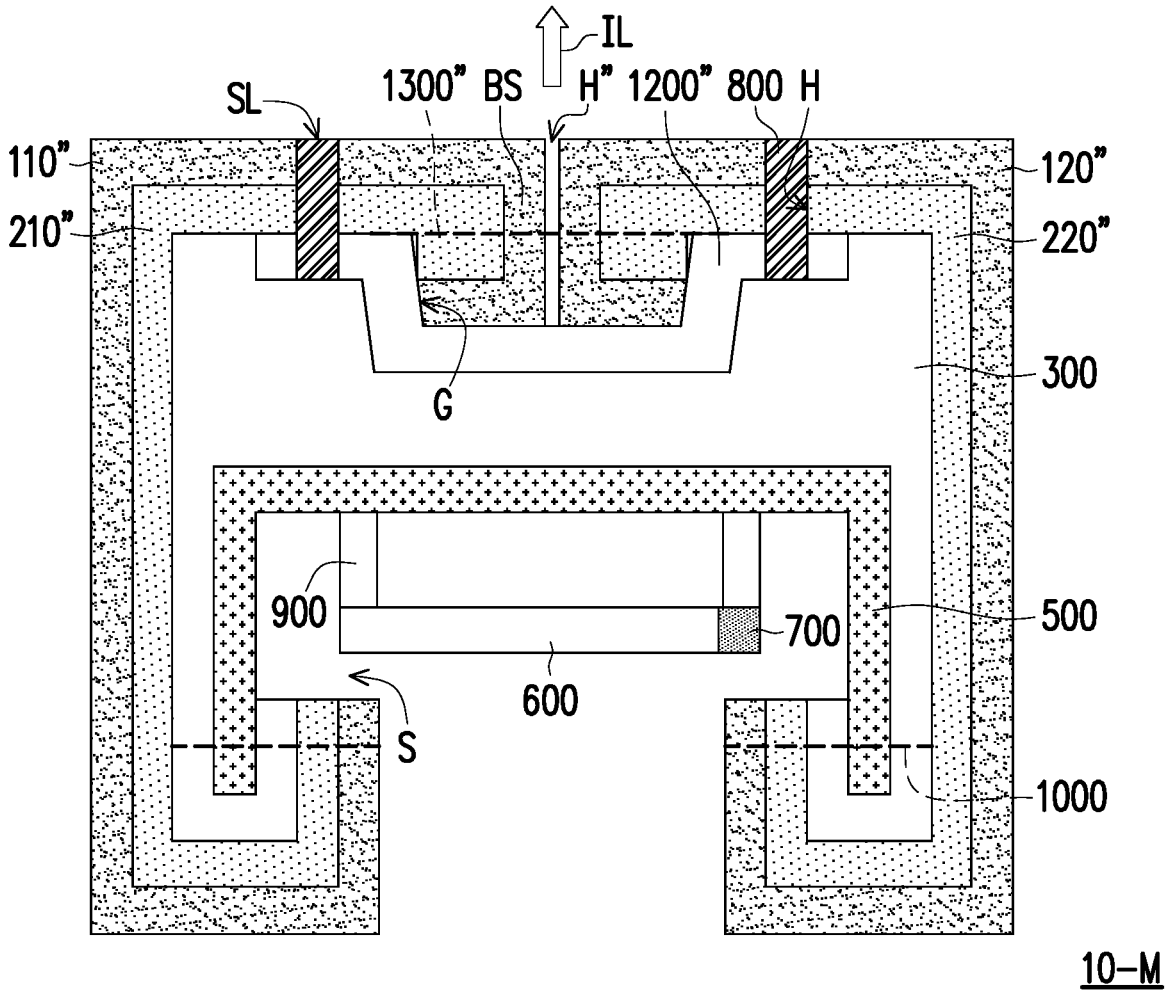
FIG. 15 is a schematic cross-sectional view of a leather workpiece according to the fifteenth embodiment of the disclosure.

FIG. 15 is a schematic cross-sectional view of a leather workpiece according to the fifteenth embodiment of the disclosure. Referring to FIG. 15, a leather workpiece 10-M is similar to the leather workpiece 10-L in FIG. 14. A main difference is that in this embodiment, the light-emitting element group 700 in the leather workpiece 10-M is disposed on the another side of the circuit board 600 perpendicular to the one side of the circuit board 600 facing the surface pattern SL. Advantages of the leather workpiece 10-M and a manufacturing method thereof are similar to those of the leather workpiece 10-L and the manufacturing method thereof. Therefore, the same details will not be repeated in the following.

Figure 16:
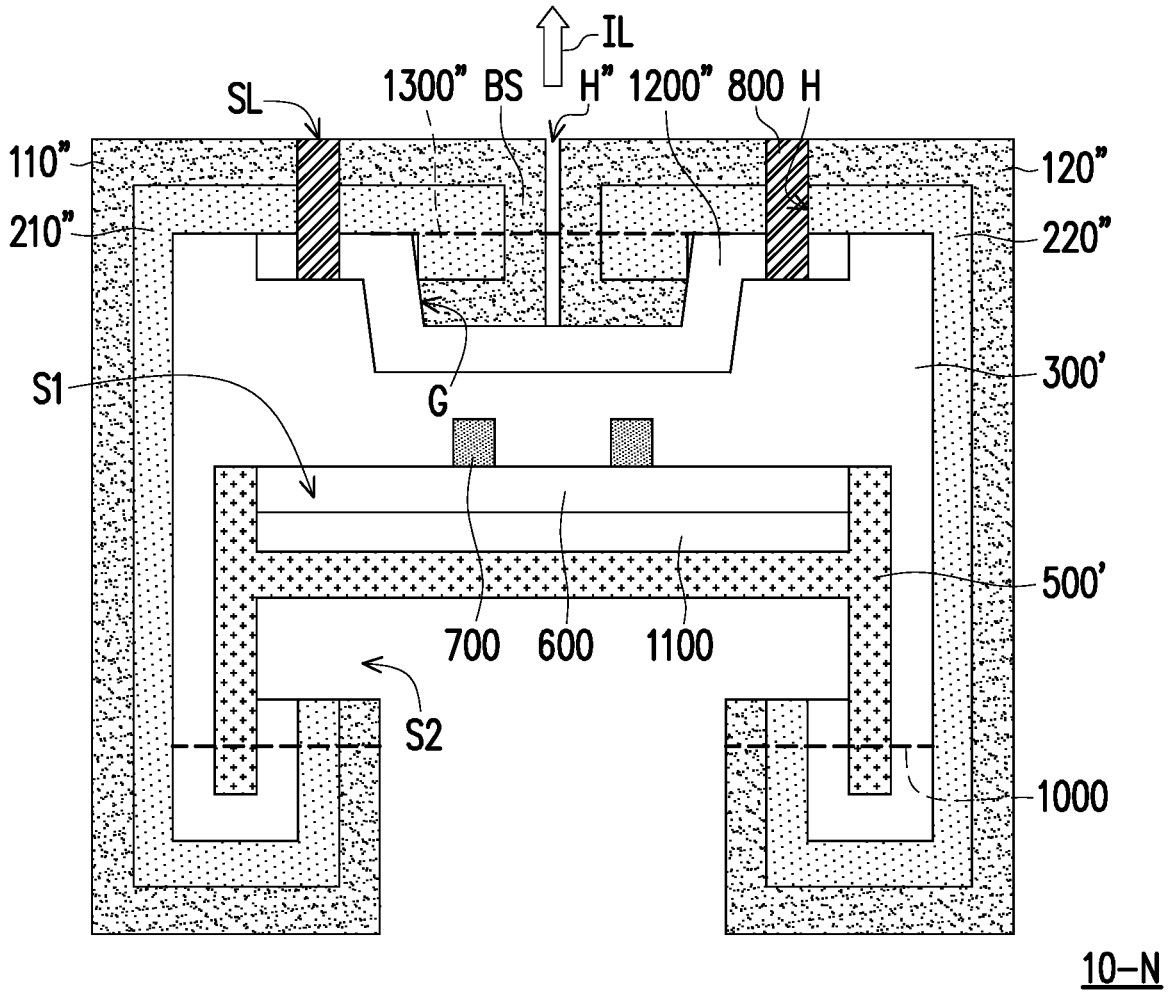
FIG. 16 is a schematic cross-sectional view of a leather workpiece according to the sixteenth embodiment of the disclosure.

FIG. 16 is a schematic cross-sectional view of a leather workpiece according to the sixteenth embodiment of the disclosure. Referring to FIG. 16, a leather workpiece 10-N is similar to the leather workpiece 10-L in FIG. 14. A main difference is that in this embodiment, the leather workpiece 10-N further includes the third adhesive layer 1100. The third adhesive layer 1100 is disposed between the second light-transmitting substrate 500' and the circuit board 600, so that the circuit board 600 is bonded to the second light-transmitting substrate 500'. The circuit board 600 is fixed on the side of the second light-transmitting substrate 500' facing the light-transmitting intermediate layer 200. Advantages of the leather workpiece 10-N and a manufacturing method thereof are similar to those of the leather workpiece 10-L and the manufacturing method thereof. Therefore, the same details will not be repeated in the following.

Figure 17:
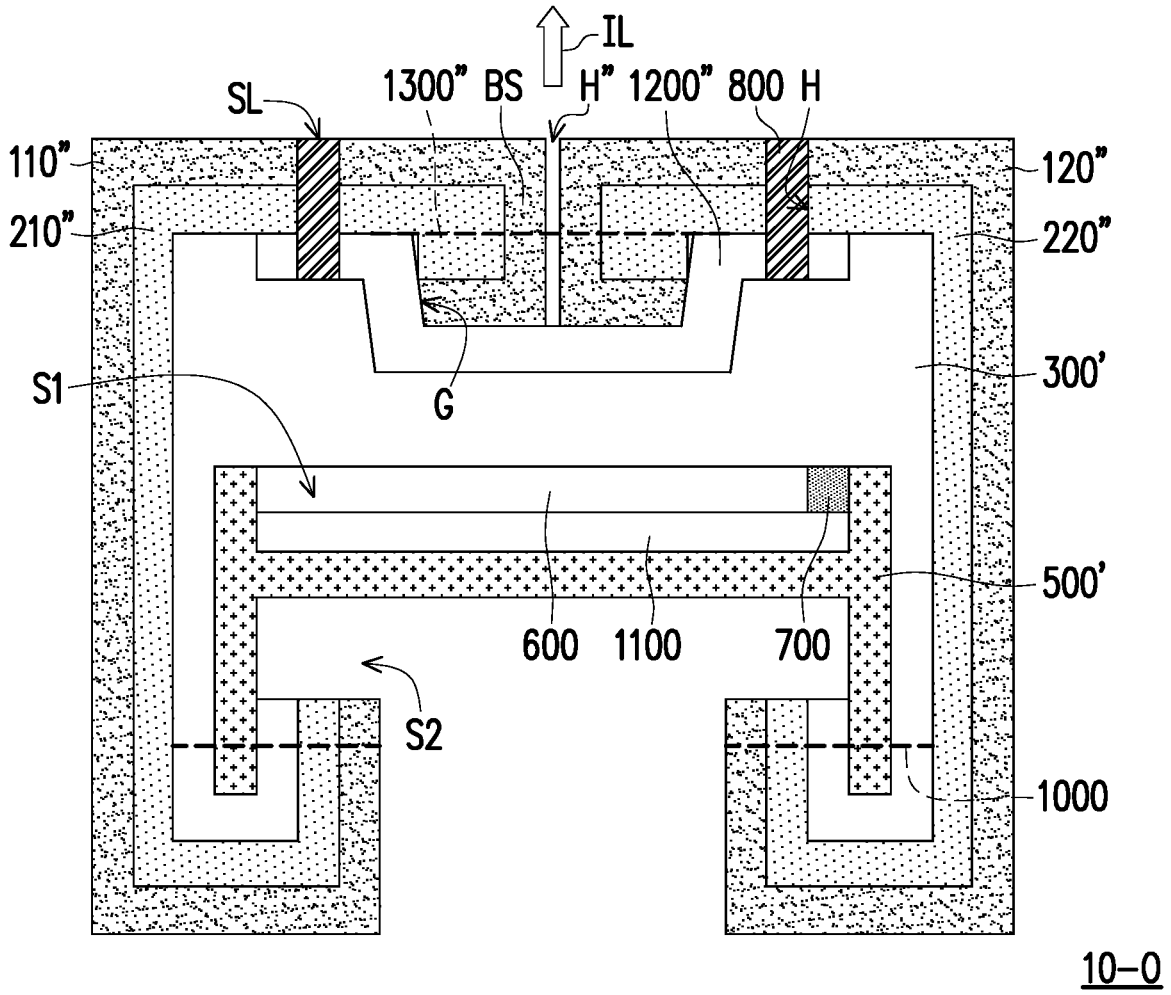
FIG. 17 is a schematic cross-sectional view of a leather workpiece according to the seventeenth embodiment of the disclosure.

FIG. 17 is a schematic cross-sectional view of a leather workpiece according to the seventeenth embodiment of the disclosure. referring to FIG. 17, a leather workpiece 10-O is similar to the leather workpiece 10-N in FIG. 16. A main difference is that the light emitting element group 700 is disposed on the another side of the circuit board 600 perpendicular to the one side of the circuit board 600 facing the surface pattern SL. Advantages of the leather workpiece 10-O and a manufacturing method thereof are similar to those of the leather workpiece 10-N and the manufacturing method thereof. Therefore, the same details will not be repeated in the following.

Figure 18A:
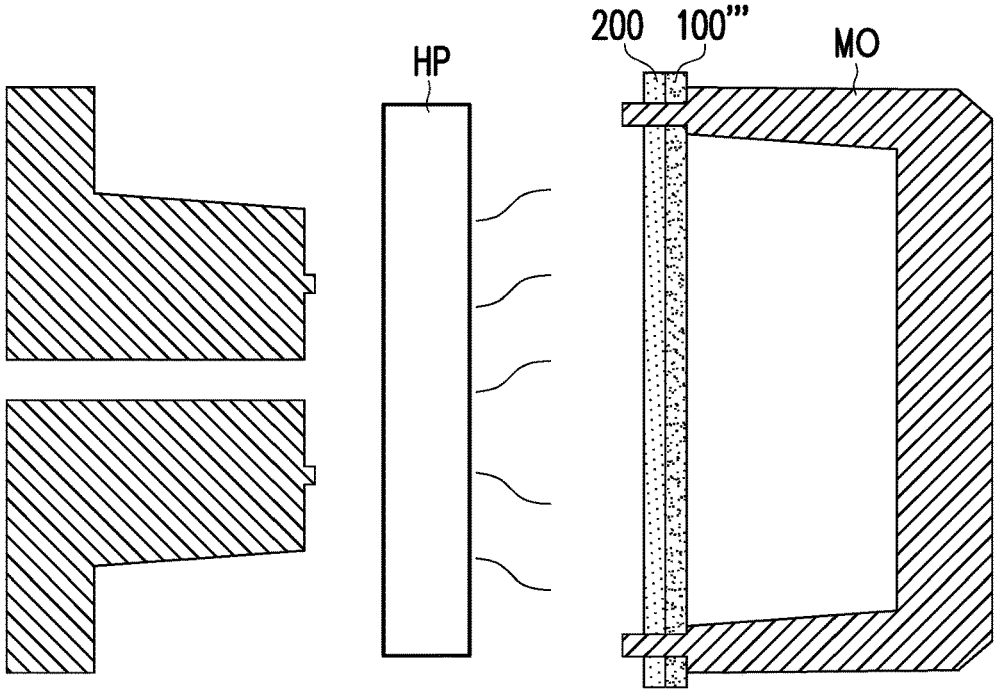
FIGS. 18A to 18D are schematic cross-sectional views of a manufacturing process of a leather workpiece according to the eighteenth embodiment of the disclosure.
Figure 18B:
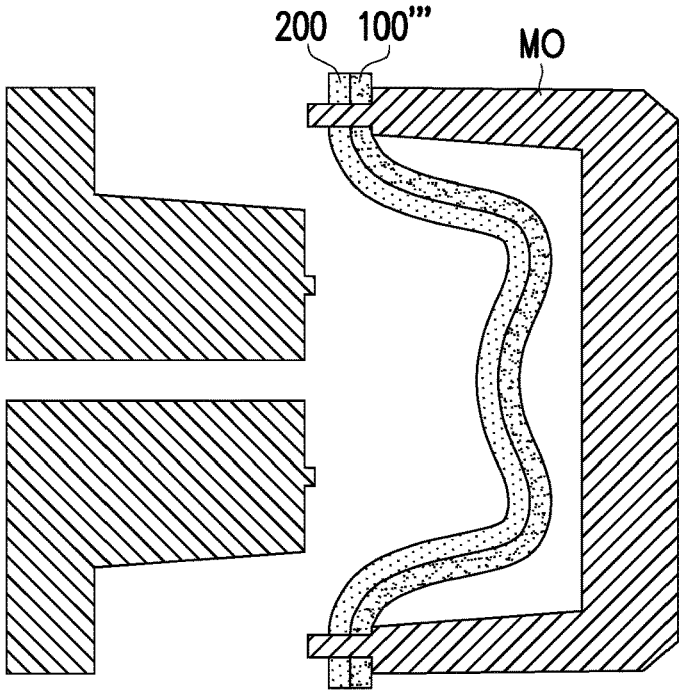
Figure 18C:
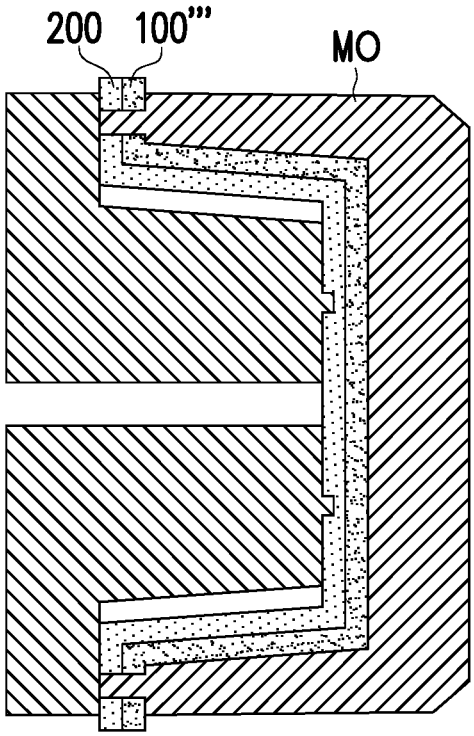
Figures 18D, 18E:
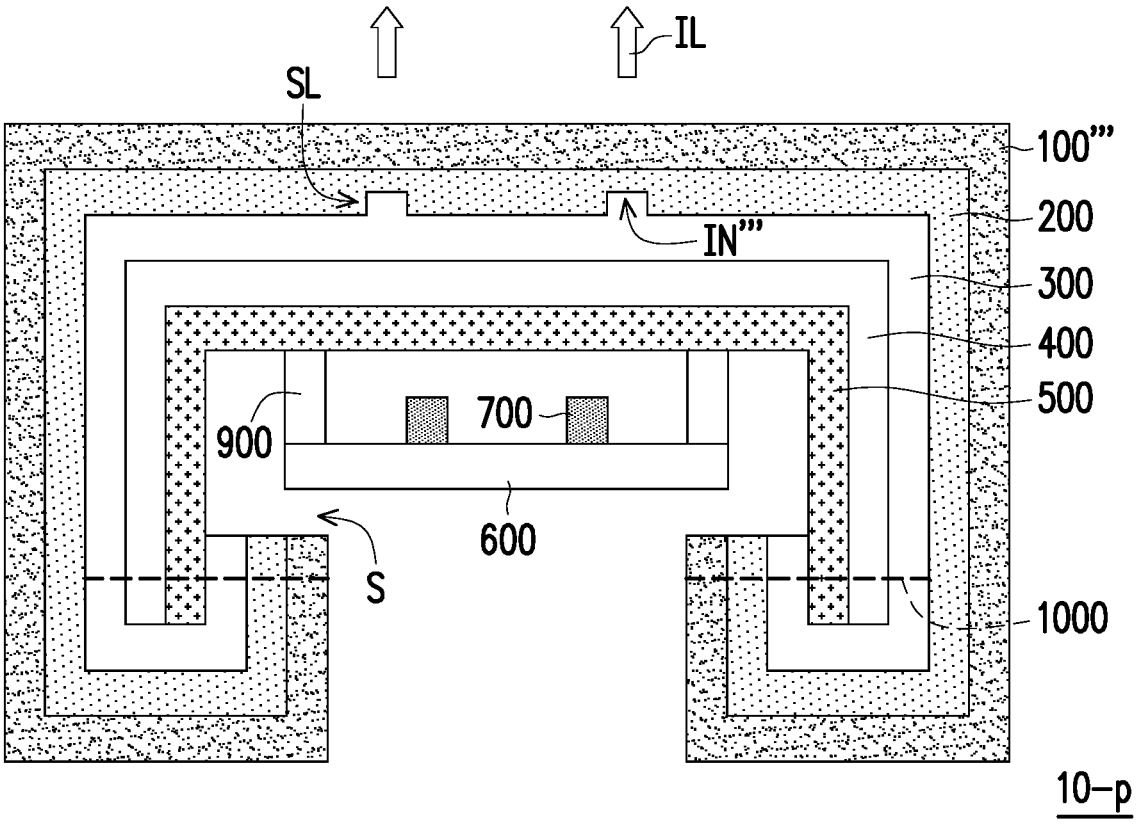
FIG. 18E is a partial flowchart of a manufacturing method of the leather workpiece according to the eighteenth embodiment of the disclosure.

FIGS. 18A to 18D are schematic cross-sectional views of a manufacturing process of a leather workpiece according to the eighteenth embodiment of the disclosure. Referring to FIG. 18D, a leather workpiece 10-P is similar to the leather workpieces 10, 10-A, 10-B, 10-C, 10-D, 10-E, 10-F, 10-G, 10-H, 10-I, 10-J, 10-K, 10-L, 10-M, 10-N, and 10-O in FIGS. 1E, 2, 3B, 4, 5, 6, 7, 8, 10B, 11, 12, 13, 14, 15, 16, and 17. A main difference is that in this embodiment, the light-transmitting intermediate layer 200 has multiple indentations IN''' on the surface toward the first adhesive layer 300. A thickness of the light-transmitting intermediate layer 200 at the indentations IN''' is less than thicknesses of other portions, and the indentations IN''' form the surface pattern SL.

FIG. 18E is a partial flowchart of a manufacturing method of the leather workpiece according to the eighteenth embodiment of the disclosure. Referring to FIGS. 18A and 18E, in this embodiment, a manufacturing method of the leather workpiece 10-P further includes the following step. In step S110''', form indentations IN''' on a surface of the light-transmitting intermediate layer 200 toward the first adhesive layer 300, so that the indentations IN''' form the surface pattern SL. In detail, as shown in FIG. 18A, the first light-transmitting substrate 100''' and the light-transmitting intermediate layer 200 is fixed first, and the first light-transmitting substrate 100''' and the light-transmitting intermediate layer 200 is heated (using a heating plate HP). Next, as shown in FIG. 18B, the first light-transmitting substrate 100''' and the light-transmitting intermediate layer 200 is adsorbed in a mold MO to form the indentations IN''' on the surface of the light-transmitting intermediate layer 200. A method of absorbing the first light-transmitting substrate 100''' and the light-transmitting intermediate layer 200 is a vacuum adsorption method. Afterwards, the first light-transmitting substrate 100''' and the light-transmitting intermediate layer 200 are taken out after cooling.

Based on the above, in an embodiment of the disclosure, the light-transmitting intermediate layer 200 of the leather workpiece 10-P has the indentations IN''' on the surface toward to the first adhesive layer 300, and the indentations IN''' form the surface pattern SL. Therefore, the surface pattern SL may be formed on the leather workpiece 10-P through fewer processes, so that a structure of the leather workpiece 10-P is simple, and the cost is reduced. Advantages of the leather workpiece 10-P and the manufacturing method thereof are similar to those of the leather workpieces 10, 10-A, 10-B, 10-C, 10-D, 10-E, 10-F, 10-G, 10-H, 10-I, 10-J, 10-K, 10-L, 10-M, 10-N, and 10-O and the manufacturing methods thereof. Therefore, the same details will not be repeated in the following.

Based on the above, in an embodiment of the disclosure, the line bodies are used for the leather workpiece and the manufacturing method thereof to stitch the first light-transmitting substrate and the light-transmitting intermediate layer to form the line apertures and the surface pattern, so that the illumination beam emitted by the light-emitting element group may pass through the line apertures and line bodies, and then the leather workpiece emits the light at the surface pattern. Therefore, the leather workpiece and the manufacturing method thereof may generate the light-emitting effect while maintaining the appearance, and enable the leather workpiece to have better ornamental properties.

What is claimed is:

1. A leather workpiece adapted to emit a light at a surface pattern, comprising:

a first light-transmitting substrate;

a first adhesive layer;

a second light-transmitting substrate, wherein the first adhesive layer is disposed between the first light-transmitting substrate and the second light-transmitting substrate;

a light-transmitting intermediate layer, disposed between the first light-transmitting substrate and the first adhesive layer, wherein the first adhesive layer is disposed between the light-transmitting intermediate layer and the second light-transmitting substrate, so that the second light-transmitting substrate is bonded to the light-transmitting intermediate layer;

a circuit board fixed on the second light-transmitting substrate; and a light-emitting element group disposed on the circuit board to emit an illumination beam, wherein the first light-transmitting substrate has the surface pattern on a surface opposite to the first adhesive layer, or the light-transmitting intermediate layer has the surface pattern on a surface toward the first adhesive layer, wherein the illumination beam sequentially passes through the first adhesive layer and the surface pattern of the first light-transmitting substrate or the light-transmitting intermediate layer, so that the leather workpiece emits the light at the surface pattern.

2. The leather workpiece according to claim 1, further comprising:

a plurality of line bodies, wherein the first light-transmitting substrate and the light-transmitting intermediate layer have a plurality of line apertures, the line bodies pass through the line apertures to form the surface pattern (a suture) and stitch the first light-transmitting substrate and the light-transmitting intermediate layer, wherein after the illumination beam is transmitted to the first light-transmitting substrate, the illumination beam passes through the line apertures and the line bodies, so that the leather workpiece emits the light at the surface pattern.

3. The leather workpiece according to claim 1, wherein the light-transmitting intermediate layer is light-transmitting optical foam or optically transparent silicone.

4. The leather workpiece according to claim 1, further comprising:

a second adhesive layer bonded on one side of the second light-transmitting substrate facing the light-transmitting intermediate layer, wherein the second light-transmitting substrate is bonded to the first adhesive layer through the second adhesive layer.

5. The leather workpiece according to claim 4, wherein the first adhesive layer and the second adhesive layer are water-based transparent adhesives.

6. The leather workpiece according to claim 1, further comprising a plurality of columnar structures, wherein the circuit board is fixed on one side of the second light-transmitting substrate opposite to the first light-transmitting substrate through the columnar structures, wherein the illumination beam first passes through the second light-transmitting substrate and is transmitted to the first adhesive layer.

7. The leather workpiece according to claim 1, wherein the light-emitting element group is disposed on one side of the circuit board facing the surface pattern.

8. The leather workpiece according to claim 1, wherein the light-emitting element group is disposed on another side of the circuit board perpendicular to one side of the circuit board facing the surface pattern.

9. The leather workpiece according to claim 1, wherein the second light-transmitting substrate is C-shaped to form an accommodation space, and the circuit board and the light-emitting element group are disposed in the accommodation space.

10. The leather workpiece according to claim 9, wherein a portion of the light-transmitting intermediate layer is extended and bonded to one side of the second light-transmitting substrate in the accommodation space through the first adhesive layer.

11. The leather workpiece according to claim 1, further comprising:

a plurality of first fixing members passing through the first light-transmitting substrate, the light-transmitting intermediate layer, the first adhesive layer, and the second light-transmitting substrate at a tail end of the leather workpiece away from the surface pattern.

12. The leather workpiece according to claim 4, further comprising:

a third adhesive layer disposed between the second light-transmitting substrate and the circuit board, so that the circuit board is bonded to the second light-transmitting substrate, wherein the circuit board is fixed on the side of the second light-transmitting substrate facing the light-transmitting intermediate layer.

13. The leather workpiece according to claim 12, wherein the second light-transmitting substrate is H-shaped to form two accommodation spaces, and the circuit board and the light-emitting element group are disposed in the accommodation space close to the surface pattern among the two accommodation spaces.

14. The leather workpiece according to claim 1, wherein the first adhesive layer is a light-transmitting double-sided adhesive.

15. The leather workpiece according to claim 1, further comprising:

a third light-transmitting substrate having a groove on one side facing the first light-transmitting substrate, wherein the light-transmitting intermediate layer is disposed between the first light-transmitting substrate and the third light-transmitting substrate, wherein the first light-transmitting substrate comprises a first sub-light-transmitting substrate and a second sub-light-transmitting substrate;

the light-transmitting intermediate layer comprises a first sub-light-transmitting intermediate layer and a second sub-light-transmitting intermediate layer;

the first sub-light-transmitting substrate and the second sub-light-transmitting substrate respectively have bending structures close to a tail end of the surface pattern, and the bending structures rest on the groove of the third light-transmitting substrate, the first sub-light-transmitting substrate, the second sub-light-transmitting substrate, the first sub-light-transmitting intermediate layer, the second sub-light-transmitting intermediate layer, and the third light-transmitting substrate have the line apertures, and the line bodies pass through the line apertures to form the surface pattern and stitch the first sub-light-transmitting substrate, the first sub-light-transmitting intermediate layer, and the third light-transmitting substrate, and stitch the second sub-light-transmitting substrate, the second sub-light-transmitting intermediate layer, and the third light-transmitting substrate; and a light-transmitting hole is formed at a junction of the bending structures, wherein the illumination beam sequentially passes through the first adhesive layer, the line apertures, and the line bodies, so that the leather workpiece emits the light at the surface pattern, or sequentially passes through the first adhesive layer, the third light-transmitting substrate, and the light-transmitting hole, so that the leather workpiece emits the light at the light-transmitting hole.

16. The leather workpiece according to claim 15 further comprising:

a plurality of second fixing members passing through the first sub-light-transmitting intermediate layer, the first sub-light-transmitting substrate, the second sub-light-transmitting substrate, and the second sub-light-transmitting intermediate layer at the junction of the bending structures.

17. The leather workpiece according to claim 1, wherein the light-transmitting intermediate layer has a plurality of indentations on the surface toward the first adhesive layer, and the indentations form the surface pattern, wherein a thickness of the light-transmitting intermediate layer at the indentations is less than thicknesses of other portions.

18. A manufacturing method of a leather workpiece, comprising:

disposing a light-transmitting intermediate layer on a first light-transmitting substrate;

forming a first adhesive layer on one side of the light-transmitting intermediate layer opposite to the first light-transmitting substrate, or forming the first adhesive layer on a second light-transmitting substrate;

using a fixture to fix the first light-transmitting substrate and the light-transmitting intermediate layer, and attaching the second light-transmitting substrate to the light-transmitting intermediate layer through the first adhesive layer;

fixing a circuit board on the second light-transmitting substrate, wherein a light-emitting element group is disposed on the circuit board, and an illumination beam emitted by the light-emitting element group sequentially passes through the first adhesive layer and a surface pattern of the first light-transmitting substrate or the light-transmitting intermediate layer, so that the leather workpiece emits a light at the surface pattern; and enabling a plurality of first fixing members to pass through the first light-transmitting substrate, the light-transmitting intermediate layer, the first adhesive layer, and the second light-transmitting substrate at a tail end of the leather workpiece away from the surface pattern.

19. The manufacturing method of the leather workpiece according to claim 18, further comprising:

using a plurality of line bodies to stitch the first light-transmitting substrate and the light-transmitting intermediate layer, wherein the first light-transmitting substrate and the light-transmitting intermediate layer are stitched to form a plurality of line apertures, and the line bodies pass through the line apertures to form the surface pattern, wherein after the illumination beam is transmitted to the first light-transmitting substrate, the illumination beam passes through the line apertures and the line bodies, so that the leather workpiece emits the light at the surface pattern.

20. The manufacturing method of the leather workpiece according to claim 18, wherein forming the first adhesive layer on the side of the light-transmitting intermediate layer opposite to the first light-transmitting substrate, or forming the first adhesive layer on the second light-transmitting substrate comprises:

forming the first adhesive layer on the side of the light-transmitting intermediate layer, and forming a second adhesive layer on the second light-transmitting substrate.

21. The manufacturing method of the leather workpiece according to claim 20, wherein using the fixture to fix the first light-transmitting substrate and the light-transmitting intermediate layer, and attaching the second light-transmitting substrate to the light-transmitting intermediate layer through the first adhesive layer comprising:

bonding the second light-transmitting substrate to the first adhesive layer through the second adhesive layer.

22. The manufacturing method of the leather workpiece according to claim 18, further comprising:

disposing a third adhesive layer on the second light-transmitting substrate, so that the circuit board is bonded to the second light-transmitting substrate.

23. The manufacturing method of the leather workpiece according to claim 19, wherein the first light-transmitting substrate comprises a first sub-light-transmitting substrate and a second sub-light-transmitting substrate, the light-transmitting intermediate layer comprises a first sub-light-transmitting intermediate layer and a second sub-light-transmitting intermediate layer, the first sub-light-transmitting substrate and the second sub-light-transmitting substrate respectively have bending structures close to a tail end of the surface pattern, and the manufacturing method of the leather workpiece further comprises:

disposing a third light-transmitting substrate on the light-transmitting intermediate layer, so that the bending structures rest on a groove of the third light-transmitting substrate.

24. The manufacturing method of the leather workpiece according to claim 23, wherein using the line bodies to stitch the first light-transmitting substrate and the light-transmitting intermediate layer comprises:

using the line bodies to stitch the first sub-light-transmitting substrate, the first sub-light-transmitting intermediate layer, and the third light-transmitting substrate, and stitch the second sub-light-transmitting substrate, the second sub-light-transmitting intermediate layer, and the third light-transmitting substrate.

25. The manufacturing method of the leather workpiece according to claim 23, further comprising:

enabling a plurality of second fixing members to pass through the first sub-light-transmitting intermediate layer, the first sub-light-transmitting substrate, the second sub-light-transmitting substrate, and the second sub-light-transmitting intermediate layer at a junction of the bending structures.

26. The manufacturing method of the leather workpiece according to claim 18, further comprising:

forming a plurality of indentations on a surface of the light-transmitting intermediate layer toward to the first adhesive layer, so that the indentations form the surface pattern, wherein a thickness of the light-transmitting intermediate layer at the indentations is less than thicknesses of other portions.

* * * * *